US006647597B2

(12) United States Patent
Reiter

(10) Patent No.: US 6,647,597 B2
(45) Date of Patent: Nov. 18, 2003

(54) ADJUSTABLE MAGNETIC SNAP FASTENER

(75) Inventor: Howard J. Reiter, Woodbridge, CT (US)

(73) Assignee: Lodestone Fasteners, LLC, Woodbridge, CT (US)

( * ) Notice: Subject to any disclaimer, the term of this patent is extended or adjusted under 35 U.S.C. 154(b) by 1 day.

(21) Appl. No.: 09/765,796

(22) Filed: Jan. 19, 2001

(65) Prior Publication Data

US 2002/0095751 A1 Jul. 25, 2002

(51) Int. Cl.[7] ..... A44B 1/00; A44B 17/00

(52) U.S. Cl. ..... 24/303

(58) Field of Search ..... 24/66.1, 303, 114.2, 24/658, 683, 684, 686, 689, 691; 248/206.5; 292/251.5; 335/285; 411/501–503

(56) References Cited

U.S. PATENT DOCUMENTS

| | | | | | |
|---|---|---|---|---|---|
| 2,389,298 | A | * | 11/1945 | Ellis | 335/303 |
| 2,389,299 | A | * | 11/1945 | Ellis | 2/96 |
| 3,102,314 | A | * | 9/1963 | Alderfer | 24/303 |
| 3,454,993 | A | * | 7/1969 | Jacobson | 24/594.11 |
| 4,204,300 | A | * | 5/1980 | Fildan | 24/578.1 |
| 4,399,595 | A | * | 8/1983 | Yoon et al. | 24/303 |
| 4,480,361 | A | * | 11/1984 | Morita | 24/303 |
| 4,748,727 | A | * | 6/1988 | Bert et al. | 24/671 |
| 4,779,314 | A | * | 10/1988 | Aoki | 24/303 |
| 4,941,236 | A | * | 7/1990 | Sherman et al. | 24/303 |
| 4,991,270 | A | * | 2/1991 | Aoki | 24/303 |
| 5,142,746 | A | | 9/1992 | Morita | 24/303 |
| 5,722,126 | A | * | 3/1998 | Reiter | 24/303 |
| 5,933,926 | A | * | 8/1999 | Reiter | 24/303 |
| 5,983,464 | A | | 11/1999 | Bauer | 24/303 |
| 6,170,131 | B1 | * | 1/2001 | Shin | 24/303 |
| 6,226,842 | B1 | * | 5/2001 | Wong | 24/303 |

FOREIGN PATENT DOCUMENTS

| | | | | |
|---|---|---|---|---|
| JP | 405335138 A | * | 12/1993 | 335/304 |
| JP | 407335429 A | * | 12/1995 | 24/303 |
| JP | 408013889 A | * | 1/1996 | 24/303 |
| WO | 0033328 | | 6/2000 | 24/303 |

* cited by examiner

*Primary Examiner*—Robert J. Sandy
*Assistant Examiner*—Ruth C. Rodriguez
(74) *Attorney, Agent, or Firm*—Cooper & Dunham LLP

(57) ABSTRACT

An adjustable magnetic snap fastener for releasably connecting two pieces of material at any one of a number of possible positions. There are a number of stems attached to one plate and a number of magnets attached to another plate. Any one of the stems fits into a hole in any one of the magnets to connect the two sections of the fastener and hence the two pieces of material. Alternatively, there are a number of magnets attached to one plate and a number of magnets attached to another plate, oriented so that every one of the magnets on the first plate is attracted to every one of the magnets on the second plate.

26 Claims, 27 Drawing Sheets

FIG. 3c
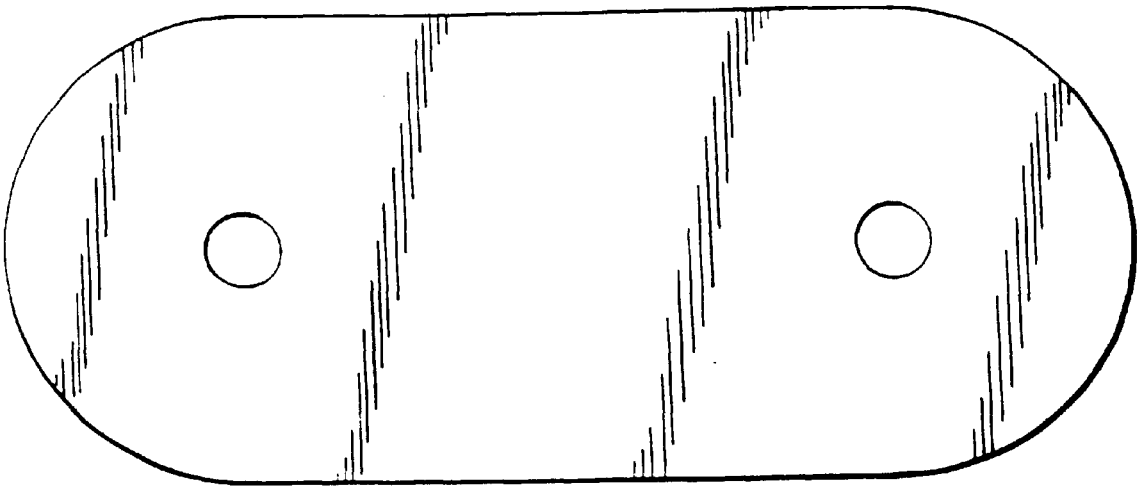
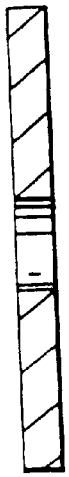
FIG. 3d

FIG. 5a
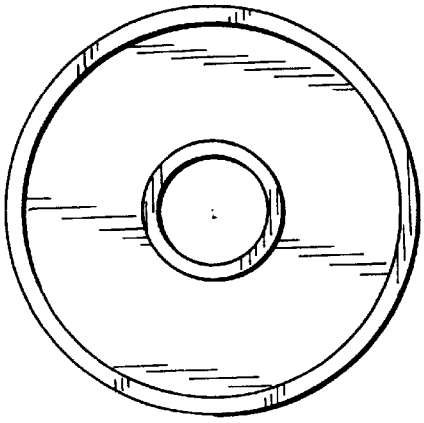
FIG. 5b
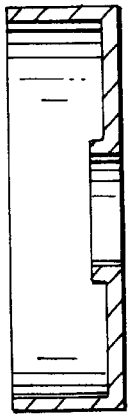
FIG. 6a
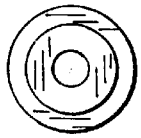
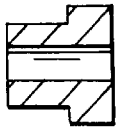
FIG. 6b
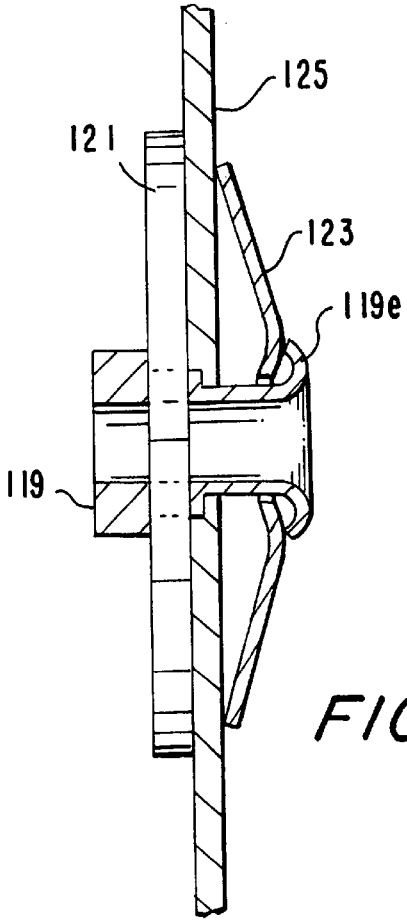
FIG. 8

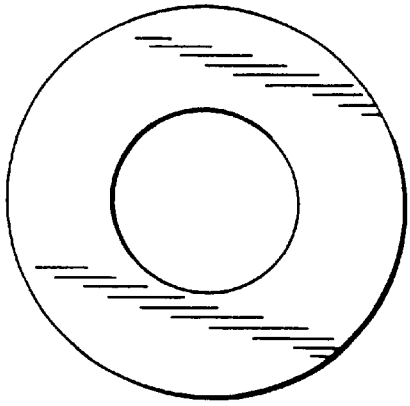
FIG. 9a
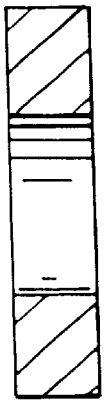
FIG. 9b
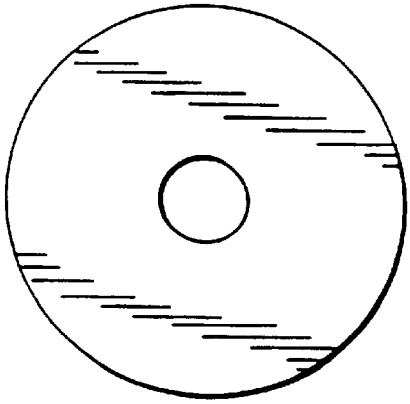
FIG. 10a
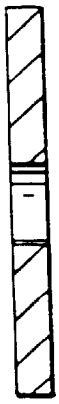
FIG. 10b
FIG. 11a
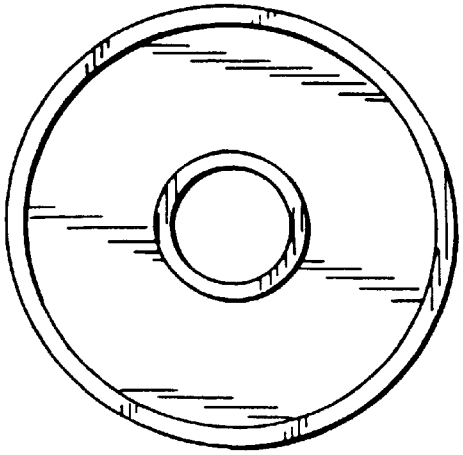
FIG. 11b
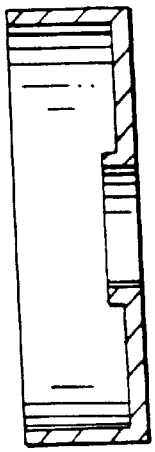

FIG. 10c
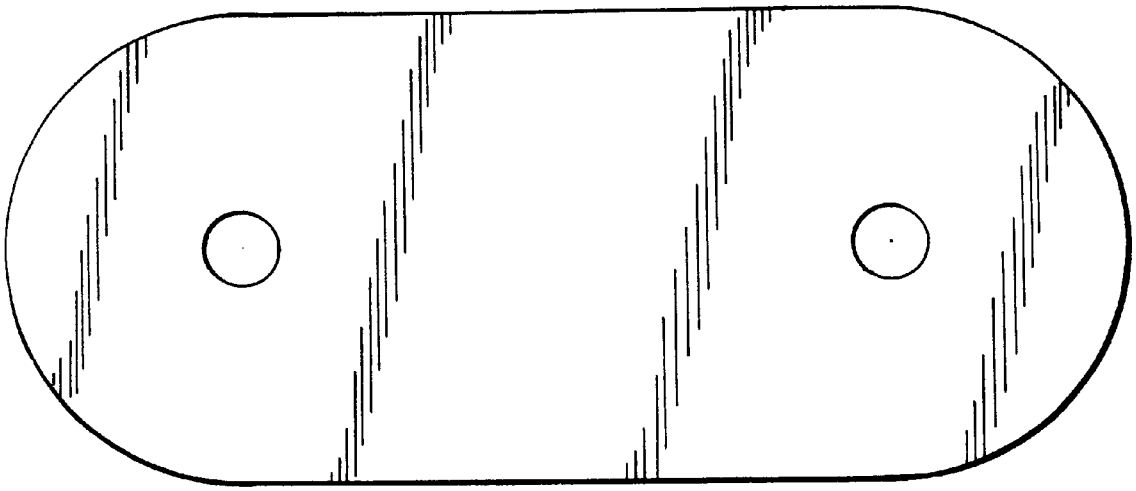
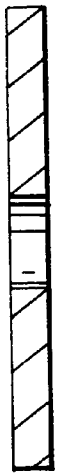
FIG. 10d

FIG. 12a
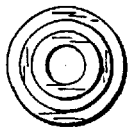
FIG. 12b
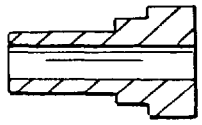
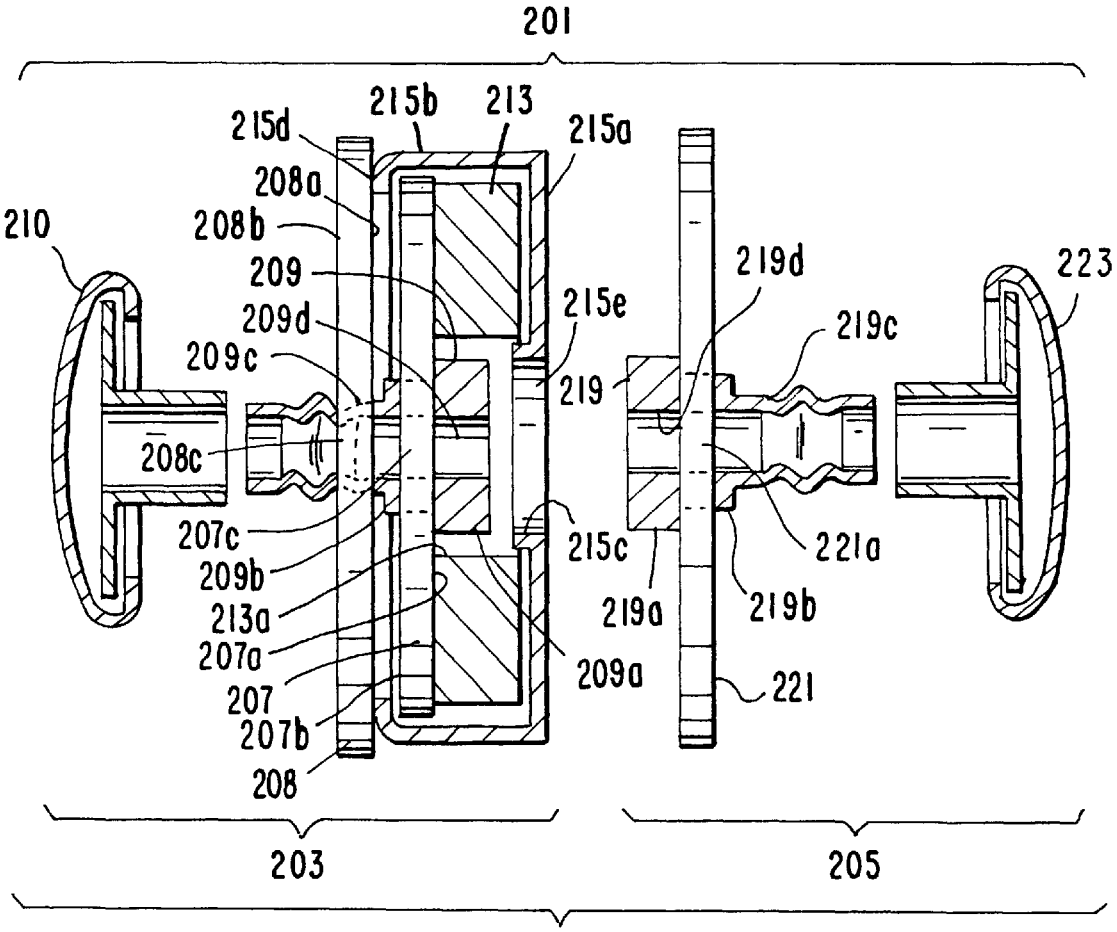
FIG. 13

FIG. 14
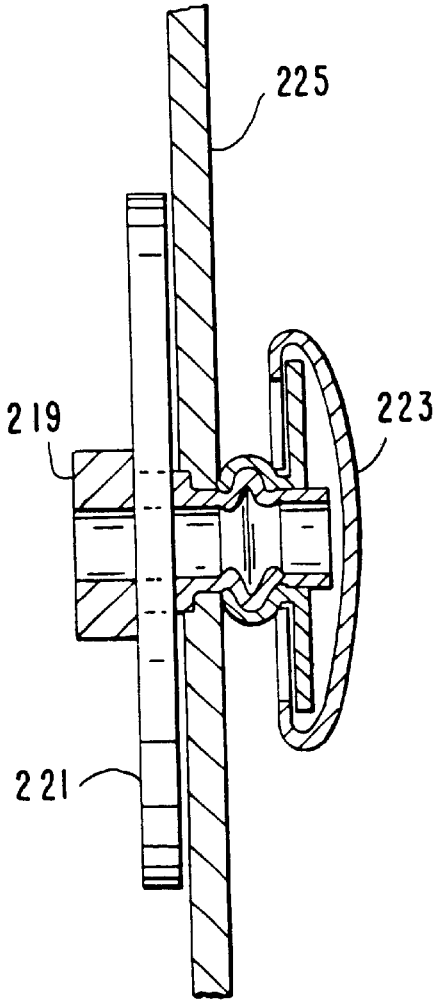
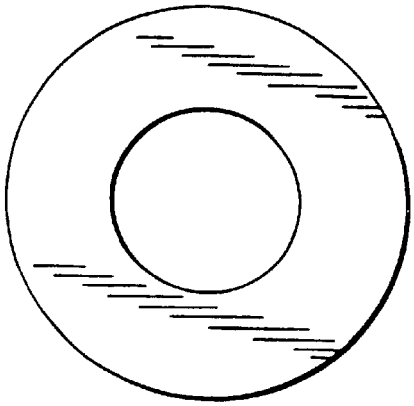
FIG. 15a
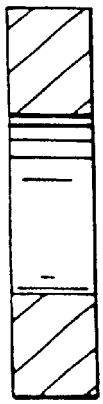
FIG. 15b

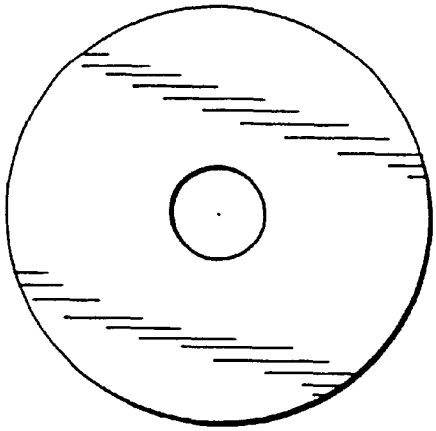
FIG. 16a
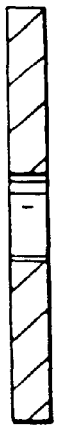
FIG. 16b
FIG. 17a
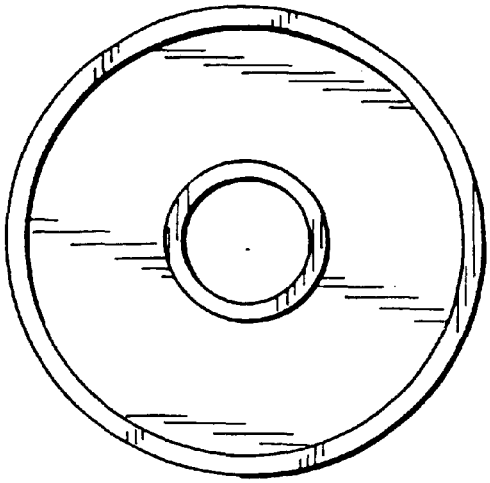
FIG. 17b
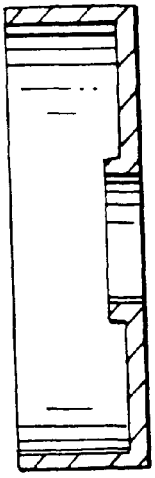
FIG. 18a
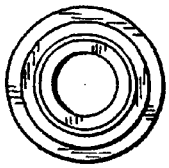
FIG. 18b
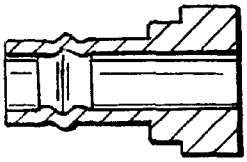

FIG. 16c
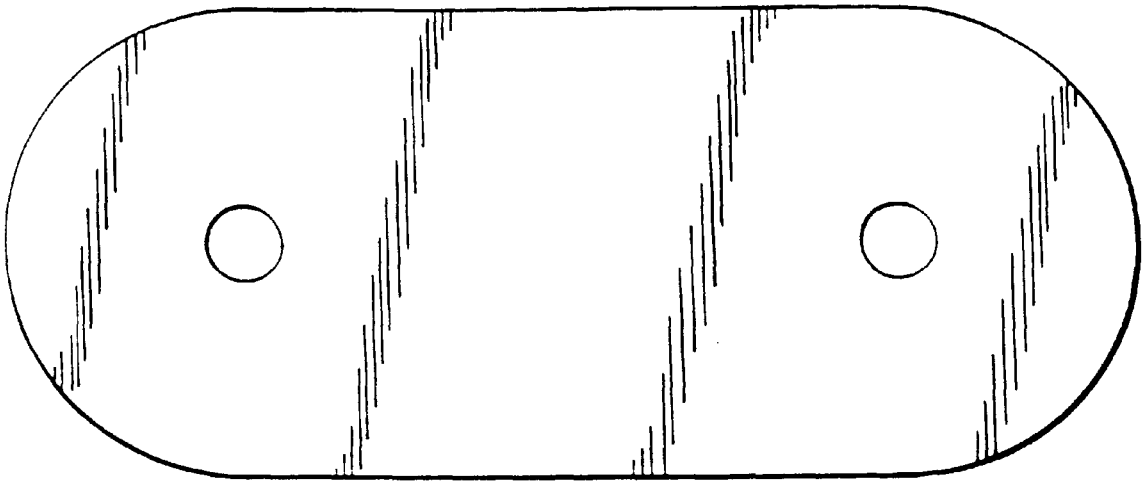
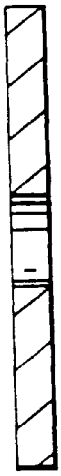
FIG. 16d

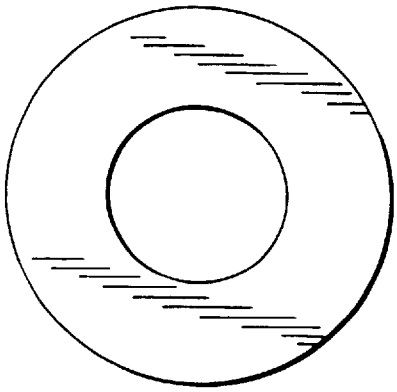
FIG. 20a
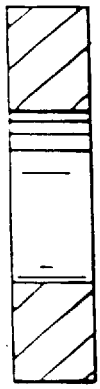
FIG. 20b
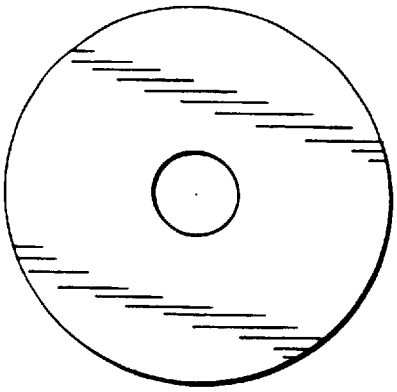
FIG. 21a
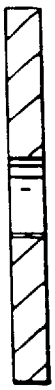
FIG. 21b
FIG. 21c
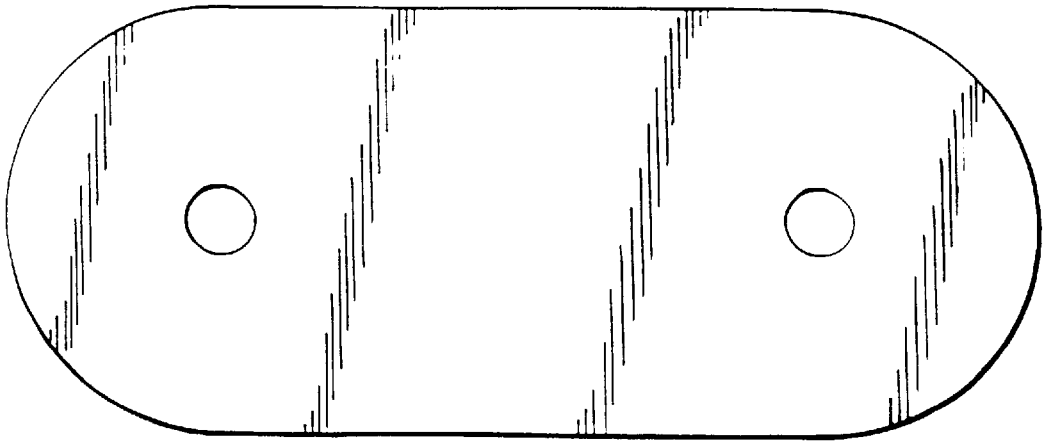

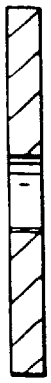
FIG. 21d
FIG. 22a
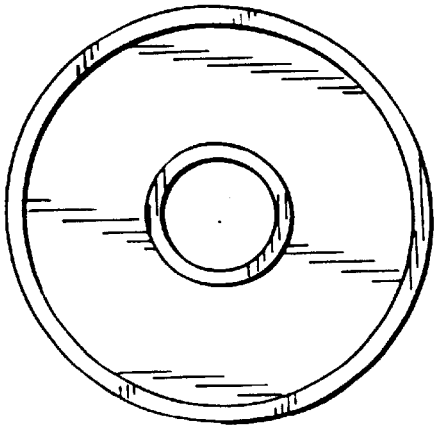
FIG. 22b
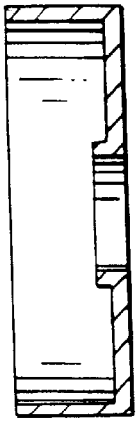
FIG. 23a
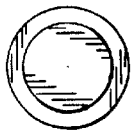
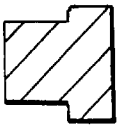
FIG. 23b

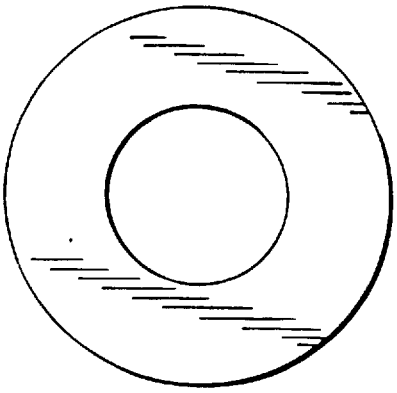
FIG. 25a
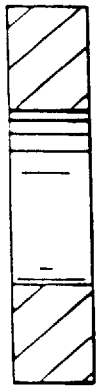
FIG. 25b
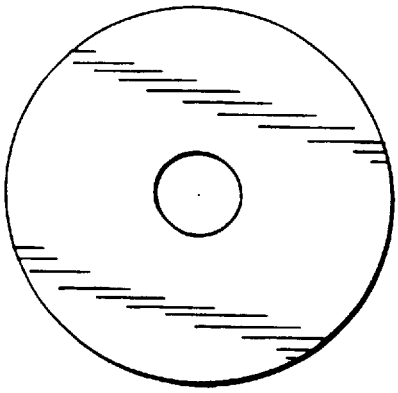
FIG. 26a
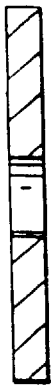
FIG. 26b
FIG. 26c
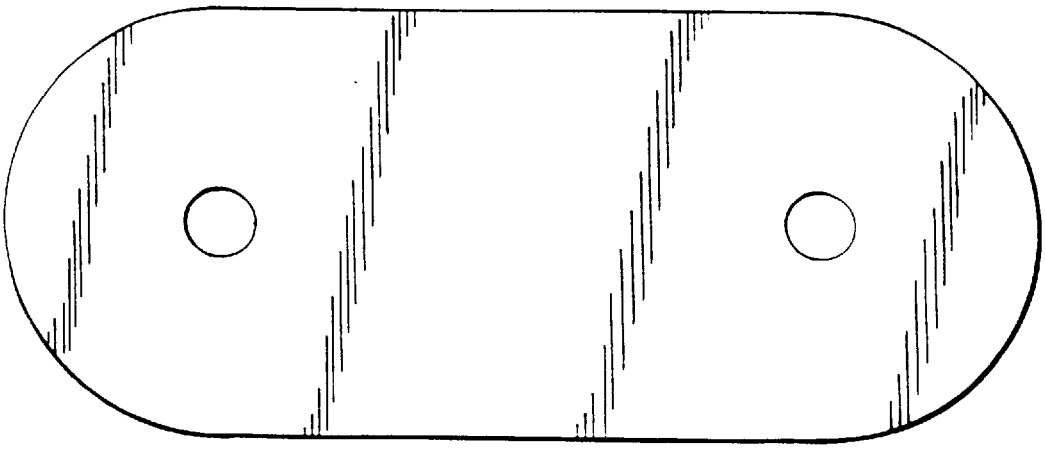

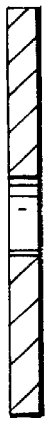
FIG. 26d
FIG. 27a
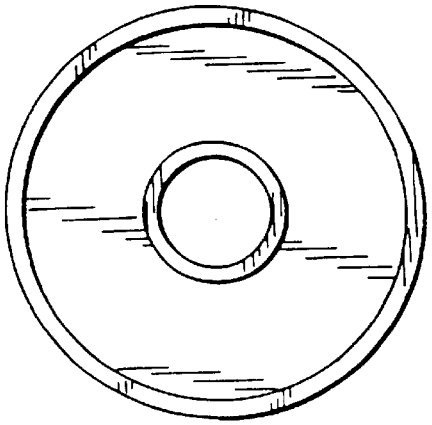
FIG. 27b
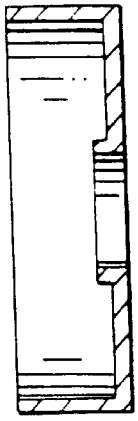
FIG. 28a
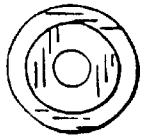
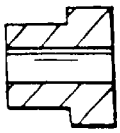
FIG. 28b FIG. 32a
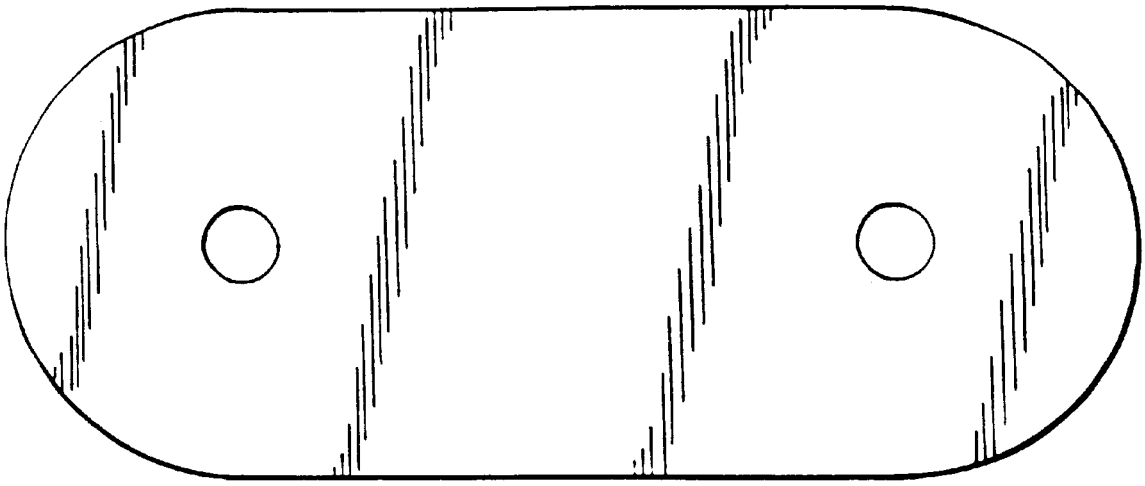
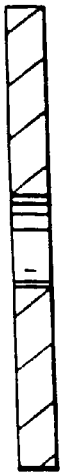
FIG. 32b

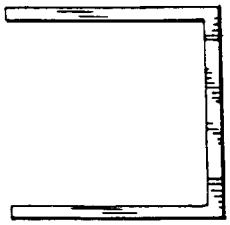
FIG. 33a
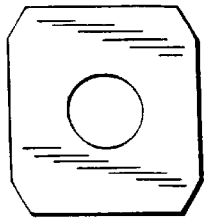
FIG. 33c
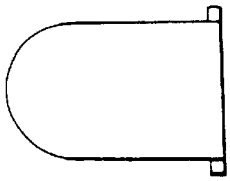
FIG. 33b
FIG. 34a
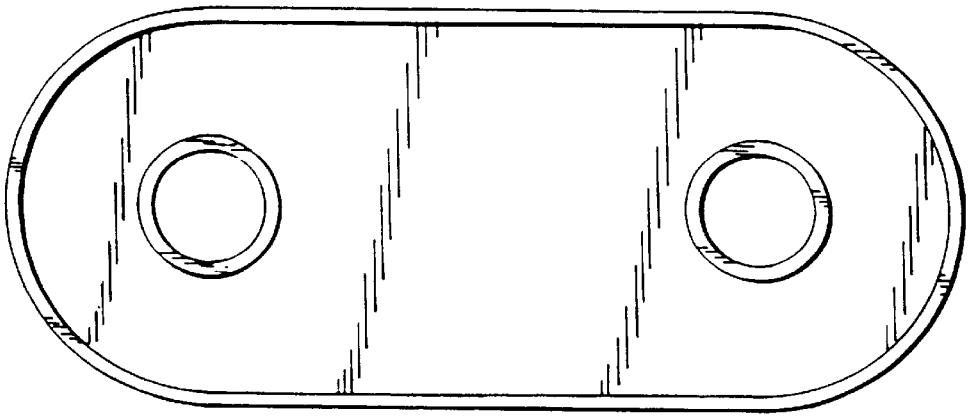
FIG. 34b
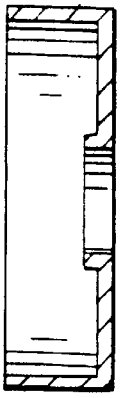
FIG. 35a
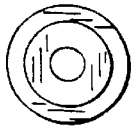
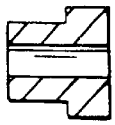
FIG. 35b

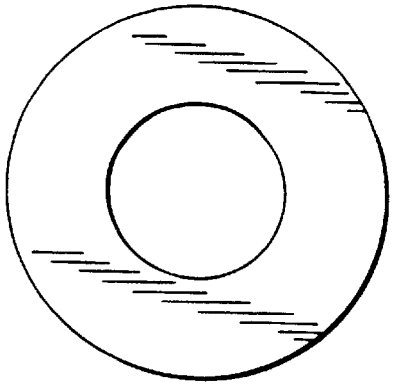
FIG. 37a
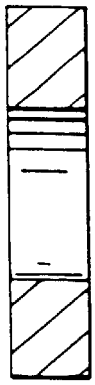
FIG. 37b
FIG. 38a
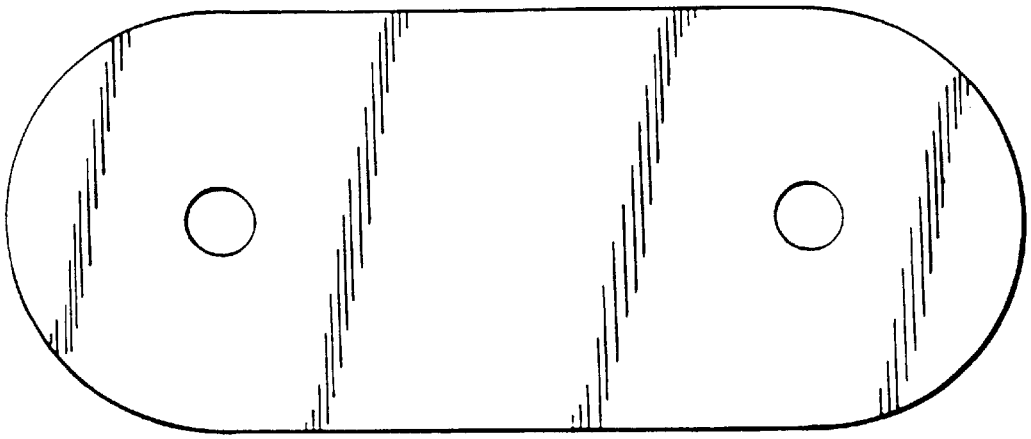
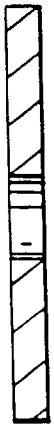
FIG. 38b

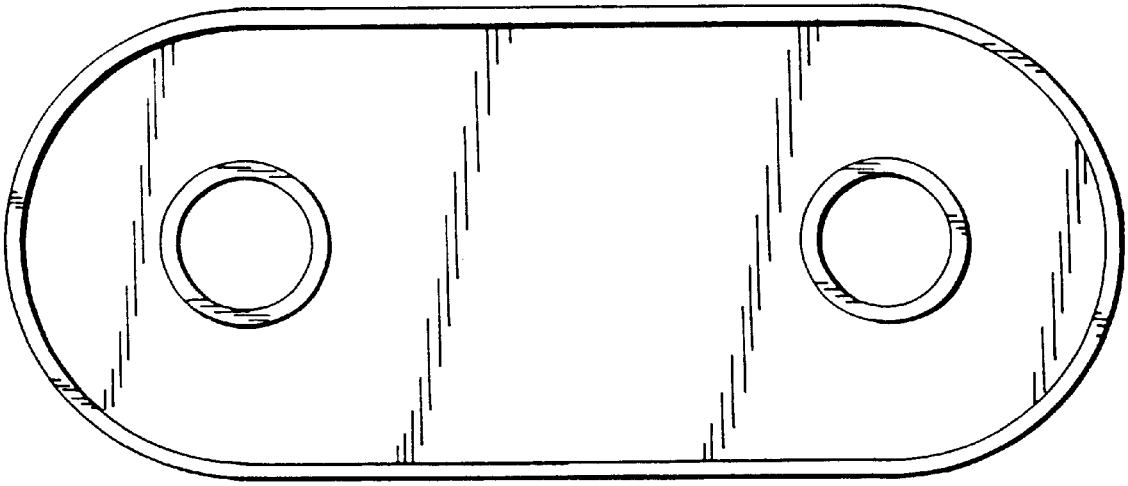
FIG. 39a
FIG. 39b
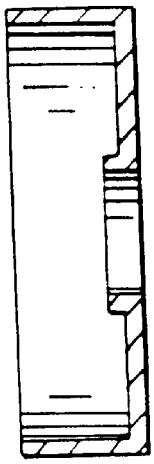
FIG. 40a
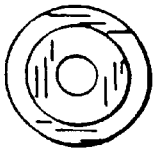
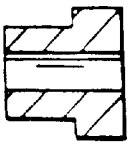
FIG. 40b

ADJUSTABLE MAGNETIC SNAP FASTENER

BACKGROUND

1. Field of the Invention

The present invention relates to adjustable magnetic snap fasteners.

2. Description of Prior Art

Magnetic snap fasteners have been used as closures for many years. U.S. Pat. Nos. 5,722,126 and 5,933,926, issued to Reiter, entitled "Magnetic Snap Fasteners", relate to magnetic snap fasteners of different configurations. These fasteners comprise a male and a female section which are magnetically coupled at a single position.

U.S. Pat. No. 4,453,294, issued to Morita, entitled "Engageable Article Using Permanent Magnet", as reexamined and confirmed under Reexamination Certificate B1 4,453,294, and U.S. Pat. No. 4,021,891, also issued to Morita, entitled "Magnetic Lock Closure," as reexamined and confirmed under Reexamination Certificate B2 4,021,891, relate to a magnetic closure wherein a solid projection on a first half of the closure engages a solid projection on a second half of the closure, which also contains a toroidal magnet. The Morita '294 and Morita '891 patents essentially describe the same product. Further, British Patent Specification No. 1,519,246, published Jul. 26, 1978, also discloses a magnetic closure. None of these patents for magnetic snap fasteners allow for multiple closed positions. Therefore, a user cannot make tighter or looser the article to which the fastener is attached.

SUMMARY OF THE INVENTION

It is therefore an object of the present invention to provide a magnetic snap fastener that has at least two of either or both of its male and female sections, or its positive and negative sections, which when put into contact allow the fastener to be closed at more than one position.

It is another object of the present invention to provide a magnetic snap fastener that allows an article to which it is attached, to be fastened more loosely or tightly.

It is yet another object of the present invention to provide a magnetic snap fastener which can be easily fabricated for sale at a commercially reasonable price.

To those ends, the instant invention relates to a fastener having either a plurality of female magnetic snap sections or a plurality of male magnetic snap sections so that the male and female sections of the fastener may be fastened at any one of a number of possible positions. Alternatively, the fastener has either a plurality of positive magnetic snap sections or a plurality of negative magnetic snap sections which may be fastened at any one of a number of possible positions. These type fasteners are readily adjustable.

These and other advantages will become apparent from the detailed description and drawings.

DESCRIPTION OF THE DRAWINGS

FIGS. 3*c* and 3*d* are a top view and a side cut-away view, respectively, of the first and second base plates of the first embodiment;

FIGS. 5*a* and 5*b* are a top view and a side cut-away view, respectively, of the non-magnetic cover of the first embodiment;

FIGS. 6*a* and 6*b* are a top view and a side cut-away view, respectively, of the tubular stem of the first embodiment;

FIG. 8 is a cross-sectional view of one male section of the embodiment of FIG. 7 attached to a piece of material;

FIGS. 9*a* and 9*b* are a top view and a side cut-away view, respectively, of the magnetic ring of the embodiment of FIG. 7;

FIGS. 10*a* and 10*b* are a top view and a side cut-away view, respectively, of the base washer of the embodiment of FIG. 7;

FIGS. 10*c* and 10*d* are a top view and a side cut-away view, respectively, of the first and second base plates of the embodiment of FIG. 7;

FIGS. 11*a* and 11*b* are a top view and a side cut-away view, respectively, of the non-magnetic cover of the embodiment of FIG. 7;

FIGS. 12*a* and 12*b* are a top view and a side cut-away view, respectively, of the tubular stems of the embodiment of FIG. 7;

FIG. 13 is a cross-sectional view of one female section and one male section of still another embodiment of the instant invention;

FIG. 14 is a cross-sectional view of one male section of the embodiment of FIG. 13 attached to a piece of material;

FIGS. 15*a* and 15*b* are a top view and a side cut-away view, respectively, of the magnetic ring of the embodiment of FIG. 13;

FIGS. 16*a* and 16*b* are a top view and a side cut-away view, respectively, of the base washer of the embodiment of FIG. 13;

FIGS. 16*c* and 16*d* are a top view and a side cut-away view, respectively, of the first and second base plates of the embodiment of FIG. 13;

FIGS. 17*a* and 17*b* are a top view and a side cut-away view, respectively, of the non-magnetic cover of the embodiment of FIG. 13; and FIGS. 18*a* and 18*b* are a top view and a side cut-away view, respectively, of the tubular stems of the embodiment of FIG. 13.

FIGS. 20*a* and 20*b* are a top view and a side cut-away view, respectively, of the magnetic ring of the embodiment of FIG. 19;

FIGS. 21*a* and 21*b* are a top view and a side cut-away view, respectively, of the base washer of the embodiment of FIG. 19;

FIGS. 21*c* and 21*d* are a top view and a side cut-away view, respectively, of the first and second base plates of the embodiment of FIG. 19;

FIGS. 22*a* and 22*b* are a top view and a side cut-away view, respectively, of the non-magnetic cover of the embodiment of FIG. 19;

FIGS. 23*a* and 23*b* are a top view and a side cut-away view, respectively, of the solid stems of the embodiment of FIG. 19;

FIGS. 25*a* and 25*b* are a top view and a side cut-away view, respectively, of the magnetic rings of the embodiment of FIG. 24*a;*

FIGS. 26*a* and 26*b* are a top view and a side cut-away view, respectively, of the base washers of the embodiment of FIG. 24*a;*

FIGS. 26*c* and 26*d* are a top view and a side cut-away view, respectively, of the base plates of the embodiment of FIG. 24*a;*

FIGS. 27*a* and 27*b* are a top view and a side cut-away view, respectively, of the non-magnetic covers of the embodiment of FIG. 24*a;*

FIGS. 28*a* and 28*b* are a top view and a side cut-away view, respectively, of the tubular stems of the embodiment of FIG. 24*a;*

FIGS. 32*a* and 32*b* are a top view and a side cut-away view, respectively, of the first and second base plates of the embodiment of FIG. 30*a;*

FIGS. 33*a*, 33*b*, and 33*c* are side views and a plan view, respectively, of the legs of the embodiment of FIG. 30*a;*

FIGS. 34*a* and 34*b* are a top view and a side cut-away view, respectively, of the non-magnetic cover of the embodiment of FIG. 30*a;*

FIGS. 35*a* and 35*b* are a top view and a side cut-away view, respectively, of the tubular stems of the first embodiment;

FIGS. 37*a* and 37*b* are a top view and a side cut-away view, respectively, of the magnetic rings of the embodiment of FIG. 36*a;*

FIGS. 38*a* and 38*b* are a top view and a side cut-away view, respectively, of the base plates of the embodiment of FIG. 36*a;*

FIGS. 39*a* and 39*b* are a top view and a side cut-away view, respectively, of the non-magnetic covers of the embodiment of FIG. 36*a;*

FIGS. 40*a* and 40*b* are a top view and a side cut-away view, respectively, of the tubular stems of the embodiment of FIG. 36*a.*

DETAILED DESCRIPTION OF THE PREFERRED EMBODIMENTS

Figure 1:
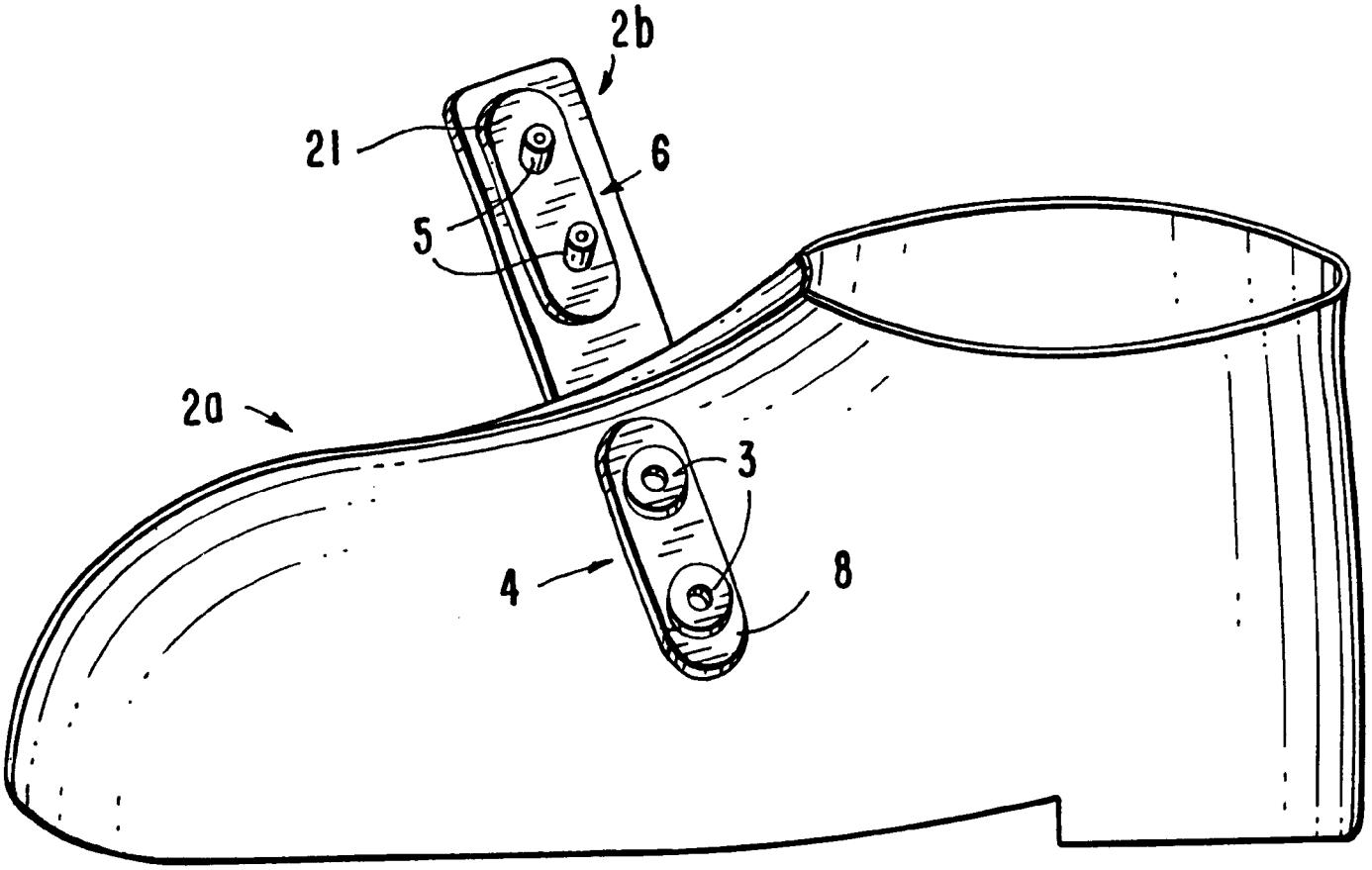
FIG. 1 is a perspective view of an adjustable magnetic snap fastener in an open position attached to a shoe.
Figure 1A:
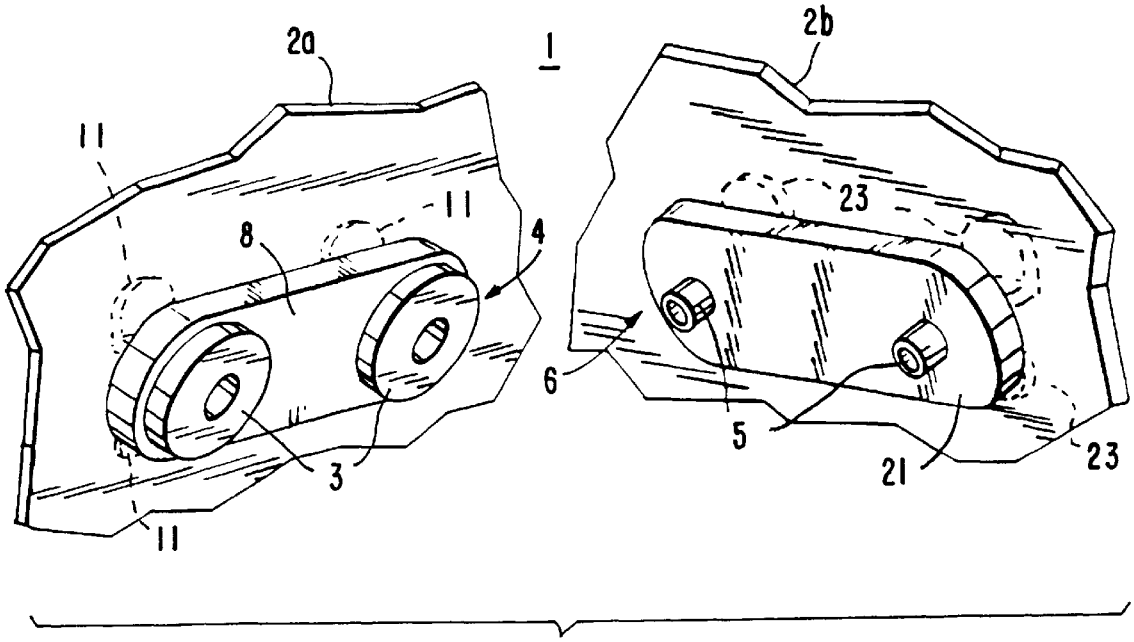
FIG. 1*a* is a perspective view showing a first embodiment of the magnetic snap fastener of the invention, having two female sections and two male sections, in open position.
Figure 1B:
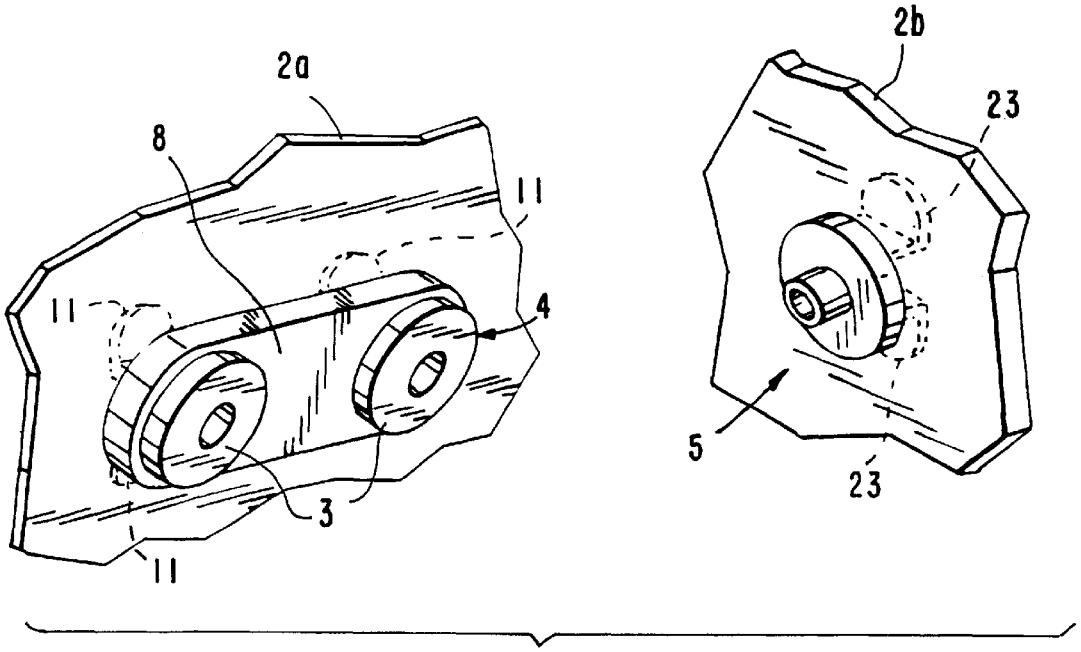
FIG. 1*b* is a perspective view showing a second embodiment of the magnetic snap fastener of the invention, having two female sections and one male section, in open position.
Figure 1C:
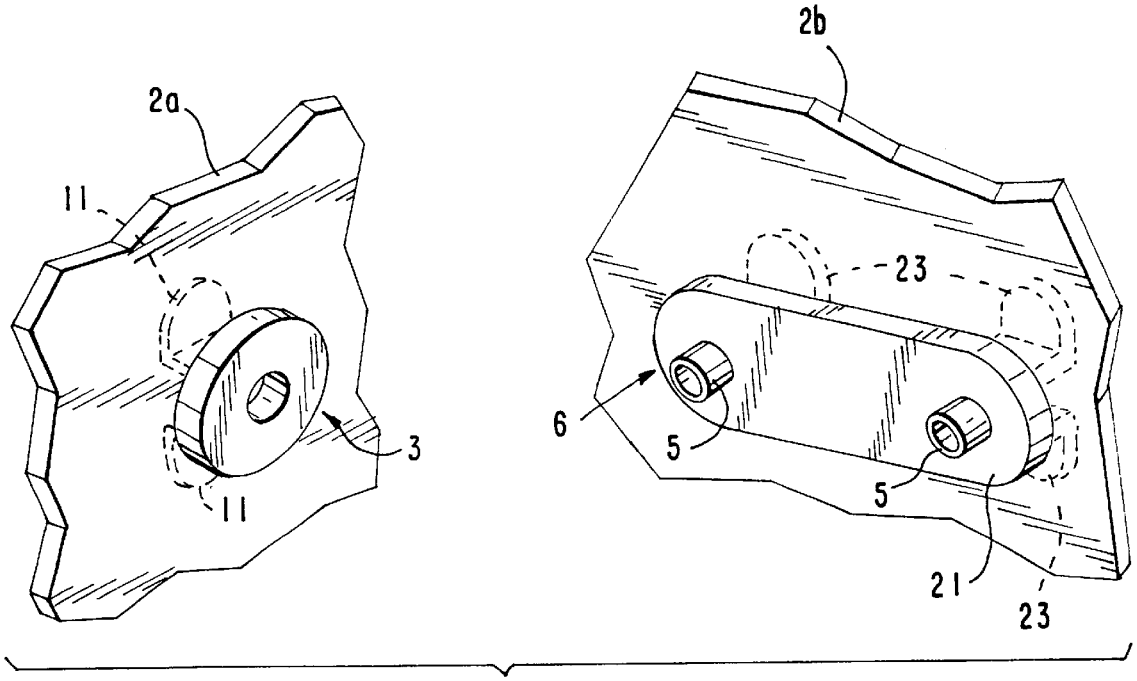
FIG. 1*c* is a perspective view showing a third embodiment of the magnetic snap fastener of the invention, having one female section and two male sections, in open position.

FIGS. 1 and 1*a* show one preferred embodiment of the invention in which a plurality of female sections 3 of an adjustable magnetic snap fastener 1 are attached to a first base plate 8 to form female fastener 4, which is attached to a first piece of material 2*a*, and a plurality of male sections 5 of an adjustable magnetic snap fastener 1 are attached to a second base plate 21 to form male fastener 6, which is attached to a second piece of material 2*b*. As shown in FIG. 1*b*, the invention alternatively may have multiple female sections 3 and one male section 5. As shown in FIG. 1*c*, in another alternative, the invention may comprise one female section 3 and multiple male sections 5. If more than one of each of the female sections 3 and male sections 5 are used, the distance between each consecutive pair of female sections 3 preferably is equal, and the distance between each consecutive pair of male sections 5 preferably is equal to the distance between each of consecutive pair of female sections 3.

Figure 1D:
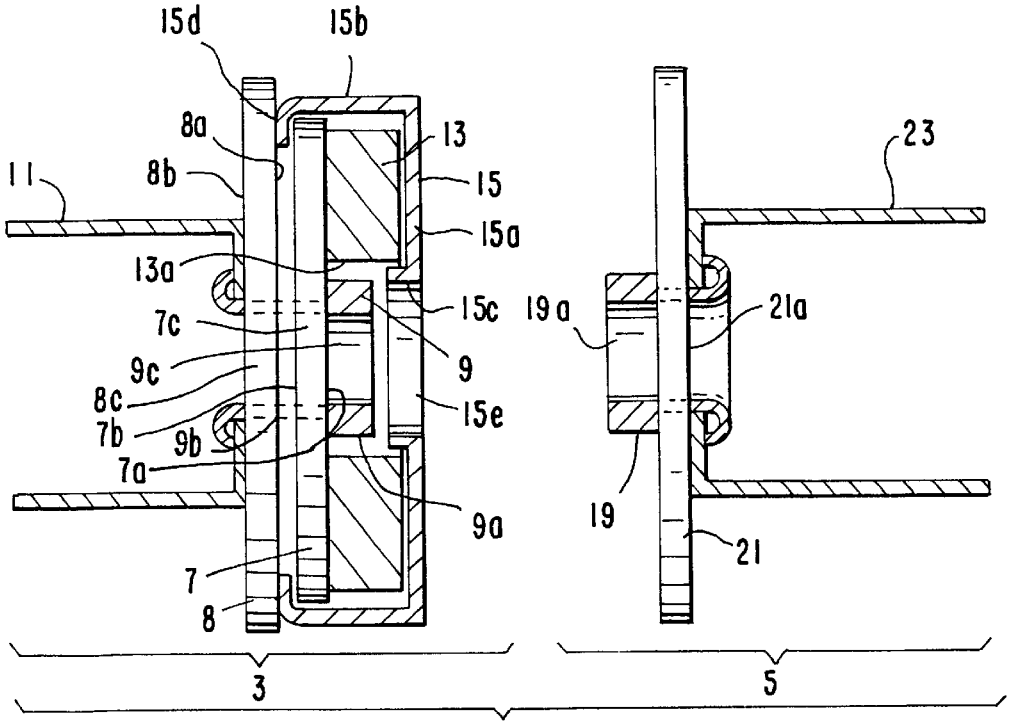
FIG. 1*d* is a cross-sectional view of one female section and one male section of the instant invention.

Referring to FIG. 1*d*, one female section 3 and one male section 5 of the first preferred embodiment of magnetic snap fastener 1 are shown separated from one another. Each female section 3 and each male section 5 is adapted so that any female section 3 and any male section 5 may mate so as to form a complete fastener.

Each female section 3 includes a base washer 7 with first side 7*a*, opposite facing second side 7*b* and central hole 7*c*. First base plate 8 has a first side 8*a* and a second side 8*b*, and for each female section 3 attached to first base plate 8, there is a corresponding hole 8*c* through base plate 8 substantially axially aligned with central hole 7*c* of that particular female section 3. Tubular stem 9 is circular in cross-section and in one embodiment has a central hole 9*c*. Tubular stem 9 also has a wide diameter section 9*a* and a narrow diameter section 9*b* and is insertable into the hole 7*c* in base washer 7 from base washer first side 7*a*, and also is insertable into the corresponding hole 8*c* in first base plate 8 from base plate first side 8*a*. The distal end of the narrow diameter section 9*b* is rolled over to affix first side 8*a* of first base plate 8 adjacent to the second side 7*b* of base washer 7, separated only by the width of continuous flange 15*d* described below, and attachment legs 11 adjacent to second side 8*b* of base plate 8. Desirably, the legs 11 are not rigidly secured so as to allow them to be rotatable with respect to base washer 7. This allows coating solutions to reach all surfaces thereby giving greater corrosion protection.

Magnetic ring 13 is held adjacent to first side 7*a* of base washer 7 by non-magnetic cover 15, which has a top 15*a* and a side wall 15*b*. Flange 15*c* helps contain magnetic ring 13 in place within the cover 15 and continuous flange 15*d* holds the cover in place relative to base washer 7. Desirably, continuous flange 15*d* is used to hold the cover 15 in place, because it is more secure than if discrete prongs or tabs are used to form a peripheral flange. Non-magnetic cover 15 may be made of brass to enhance the appearance of the fastener. Desirably also, flange 15*d* is continuous about the periphery of cover 15 so that the cover is not easily removable and lies flat against the piece of material. Magnetic ring 13 is toroidal in shape and has a central hole 13*a* larger than the outside diameter of the wide diameter section 9*a* of tubular stem 9. Since tubular stem 9 and non-magnetic cover 15 have central holes 9*c* and 15*e*, respectively, they are substantially axially aligned with central hole 7*c* of base washer 7 and corresponding hole 8*c* of first base plate 8.

Turning now to male sections 5 of magnetic snap fastener 1, it is seen that second tubular stem 19 connects second base plate 21 to attachment legs 23 in a manner similar to that used in connection with each female section 3. Here again, in this embodiment, second tubular stem 19 has a central hole 19*a* that is substantially axially aligned with a corresponding hole 21*a* of second base plate 21. The attachment legs 23 desirably are not rigidly secured so that they are rotatable with respect to second base plate 21.

As is clear from FIGS. 1*a* through 1*d*, second tubular stem 19 of one male section 5 is insertable into hole 15*e* of non-magnetic cover 15 of one female section 3. Due to the force of the magnetic ring 13, the male section 5 and female section 3 snap together. Legs 11 and 23 may, of course, be attached to two respective pieces of material 2*a* and 2*b*. Thus, the two pieces of material 2*a* and 2*b* are attached when one female section 3 and one male section 5 are snapped together.

Figure 2A:
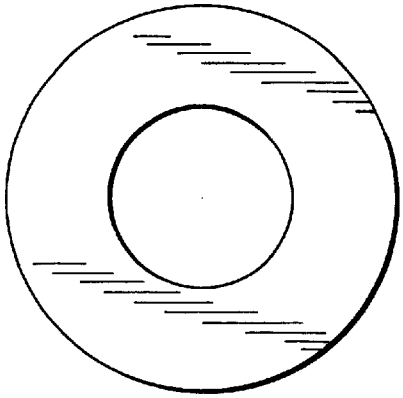
FIGS. 2*a* and 2*b* are a top view and a side cut-away view, respectively, of the magnetic ring of the first embodiment.
Figure 2B:
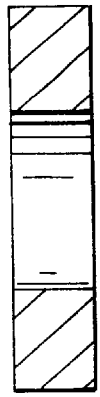
Figure 3A:
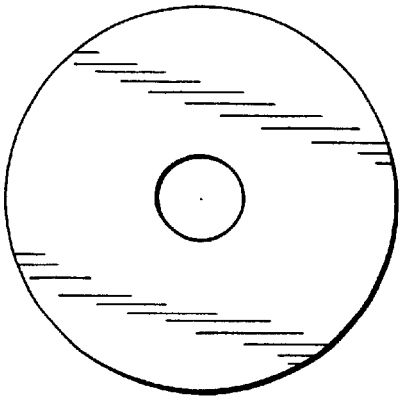
FIGS. 3*a* and 3*b* are a top view and a side cut-away view, respectively, of the base washer of the first embodiment.
Figure 3B:
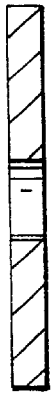
Figure 4A:
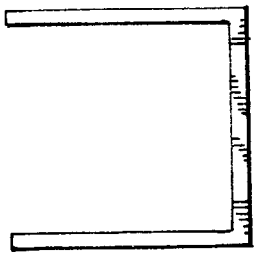
FIGS. 4*a*, 4*b*, and 4*c*, are side views and a plan view, respectively, of the legs of the first embodiment.
Figure 4C:
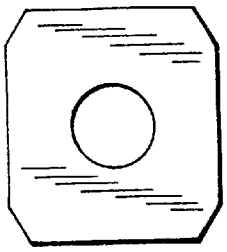
Figure 4B:
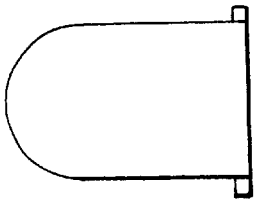

FIGS. 2*a* and 2*b* show a top view and a side cut-away view, respectively, of the magnetic ring 13. FIGS. 3*a* and 3*b* show a top view and a side cut-away view, respectively, of the base washer 7. FIGS. 3*c* and 3*d* show a top view and a side cut-away view, respectively, of both the first and second base plates 8 and 21. FIGS. 4*a*, 4*b*, and 4*c* show side views and a plan view, respectively, of both the legs 11 and 23. FIGS. 5*a* and 5*b* show a top view and a side cut-away view, respectively, of the non-magnetic cover 15. FIGS. 6*a* and 6*b* show a top view and side cut-away view, respectively, of both the tubular stems 9 and 19. It is a particular feature of this embodiment of the invention that the legs and tubular stems are identical on both the female and male sections of the fastener. If the number of female sections is equal to the number of male sections, both base plates also are identical. This reduces the number of different parts needed to make a complete assembly. The axially aligned holes in the components may serve as a distinguishing feature of products made in accordance with the invention.

It is important that each of the openings are in axial alignment. Thus, when a female section 3 and a male section 5 are magnetically attached to one another, central holes 7*c*, 9*c*, 13*a*, 15*e*, and 19*a* of the female section 3 and the male section 5, as well as corresponding holes 8*c* and 21*a* of base plates 8 and 21, form a straight path. This path should not be too large in diameter. For example, the diameter should be about 0.006 to 0.125 inch. However, the size of the hole is within the level of ordinary skill in the art.

Figure 7:
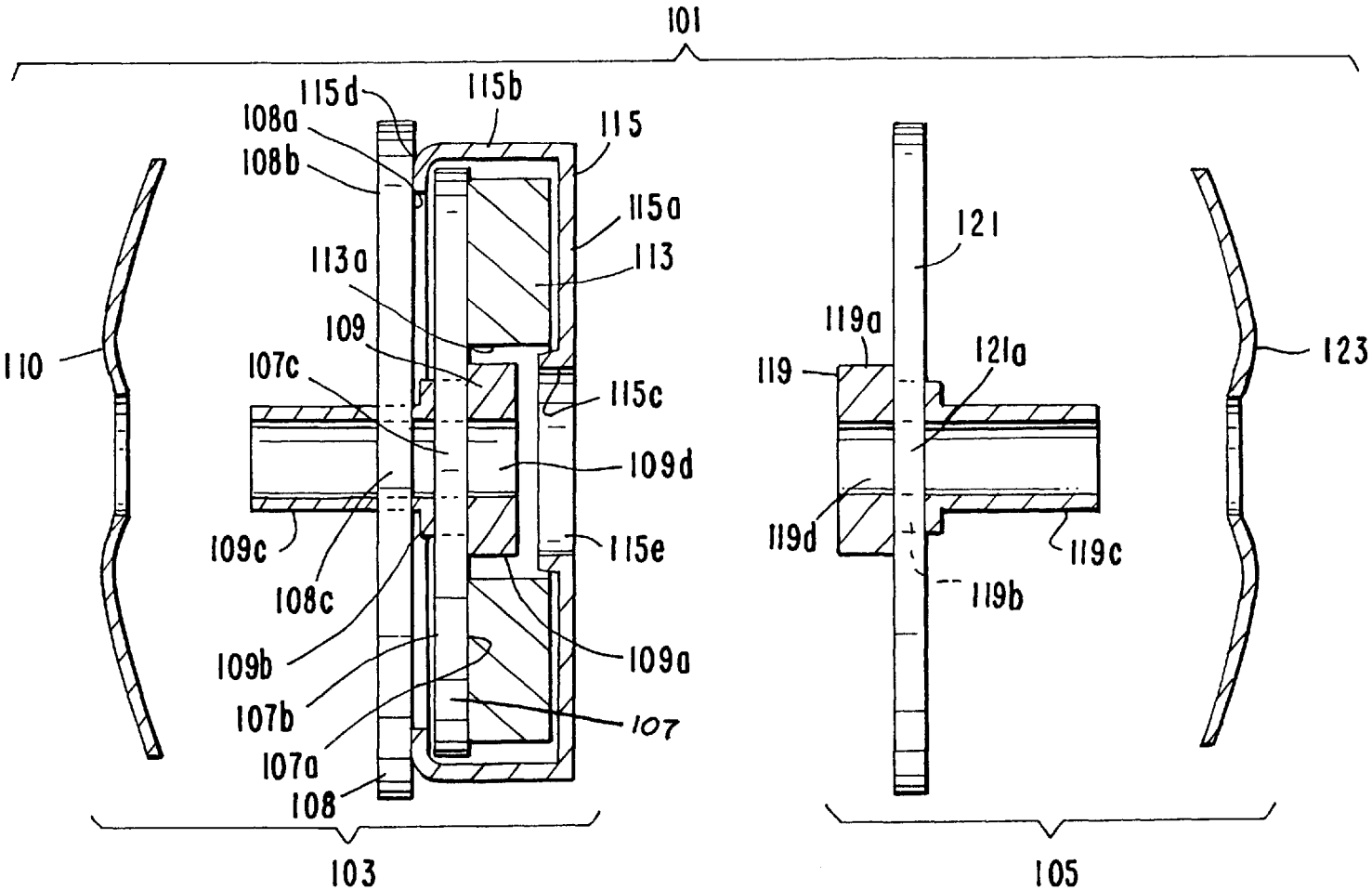
FIG. 7 is a cross-sectional view of one female section and one male section of another embodiment of the instant invention.

Another preferred embodiment of the present invention comprises a female fastener and a male fastener that may be attached to pieces of material using rolled rivets instead of legs. Referring to FIG. 7, one female section 103 and one male section 105 of this preferred embodiment of magnetic snap fastener 101 are shown separated from one another. Each female section 103 and each male section 105 is adapted so that any female section 103 and any male section 105 may mate to form a complete snap fastener. Magnetic snap fastener 101 is a rolled rivet type of fastener.

Each female section 103 includes a base washer 107 with first side 107*a*, opposite facing second side 107*b* and central hole 107*c*. A first base plate 108 has a first side 108*a* and a second side 108*b*, and for each female section 103 attached to first base plate 108, there is a corresponding hole 108*c* through base plate 108 substantially axially aligned with central hole 107*c* of that particular female section 103. Tubular stem 109 is circular in cross section and has a wide diameter section 109*a*, a medium diameter section 109*b*, a narrow diameter section 109*c*, and a central hole 109*d*. Tubular stem 109 may be inserted into the central hole 107*c* from base washer first side 107*a* and into the corresponding hole 108*c* in first base plate 108 from base plate first side 108*a*. The distal end of the narrow diameter section 109*c* extends outward from first base plate 108 to engage first attachment washer 110, as shown more clearly in FIG. 8 and as discussed below. There are no legs in this embodiment to attach the sections of the fastener to pieces of material. Rather, the sections of the fastener are attached by the rolled rivet connectors.

Magnetic ring 113 is held adjacent to first side 107*a* of base washer 107 by non-magnetic cover 115, which has a top 115*a* and a side wall 115*b*. Flange 115*c* helps contain magnetic ring 113 in place within the cover 115 and continuous flange 115*d* holds the cover in place relative to base washer 107. Magnetic ring 113 is toroidal in shape and has a central hole 113*a* larger than the outside diameter of the wide diameter section 109*a* of tubular stem 109. In this embodiment, tubular stem 109 and non-magnetic cover 115 have central holes 109*d* and 115*e*, respectively, which are substantially axially aligned with hole 107*c* of base washer 107 and corresponding hole 108*c* of first base plate 108.

Turning now to male sections 105 of magnetic snap fastener 101 it is seen that second tubular stem 119, including wide section 119*a*, medium section 119*b*, and narrow section 119*c*, is insertable through a corresponding hole 121*a* of second base plate 121 in a manner similar to that used in connection with each female section 103. Here again, in this embodiment, second tubular stem 119 has a central hole 119*d* that is substantially axially aligned with corresponding hole 121*a* of second base plate 121. Moreover, as described in connection with female sections 103, the distal end of narrow diameter section 119*c* extends outward from second base plate 121 to engage second attachment washer 123, as shown more clearly in FIG. 8 and as discussed below.

FIG. 8 shows one male section 105 attached to a piece of material 125 held between second base plate 121 and second attachment washer 123. As seen in FIG. 8, tubular stem 119 has section 119*e* rolled over to hold attachment washer 123 in place. Each female section 103 is attached to a piece of material in a similar manner. Thus, the mating of one female section 103 and one male section 105 results in attachment of the two pieces of material.

FIGS. 9*a* and 9*b* show a top view and a side cut-away view, respectively, of the magnetic ring 113. FIGS. 10*a* and 10*b* show a top view and a side cut-away view, respectively, of the base washer 107. FIGS. 10*c* and 10*d* show a top view and a side cut-away view, respectively, of both the first and second base plates 108 and 121. FIGS. 11*a* and 11*b* show a top view and side cut-away view, respectively, of the non-magnetic cover 115. FIGS. 12*a* and 12*b* show a top view and a side cut-away view, respectively, of both the tubular stems 109 and 119. Once again, several of these components are identical on the male and female sides so as to provide for easy assembly and to reduce the cost of the finished product.

Still another preferred embodiment of the present invention comprises female sections and male sections that may be attached to pieces of material using Kwik-rivet connectors. Referring to FIG. 13, one female section 203 and one male section 205 of this preferred embodiment of magnetic snap fastener 201 are shown separated from one another. Each female section 203 and each male section 205 is designed so that any female section 203 and any male section 205 may unite to form a magnetic snap fastener of the Kwik-rivet style.

Each female section 201 includes a base washer 207 with first side 207*a*, oppositely facing second side 207*b*, and central hole 207*c*. First base plate 208 has a first side 208*a* and a second side 208*b*, and for each female section 203 attached to first base plate 208, there is a corresponding hole 208*c* through base plate 208 substantially axially aligned with central hole 207*c* of that particular female section 203. Tubular stem 209, which is circular in cross-section and which has a wide diameter section 209*a*, a medium diameter section 209*b*, and a narrow diameter section 209*c*, is insertable into the central hole 207*c* from base washer first side 207*a* and into the corresponding hole 208*c* in first base plate 208 from base plate first side 208*a*. The distal end of the narrow diameter section 209*c* extends outward from first base plate 208 to engage first rivet cap 210, as shown more clearly in FIG. 14 and as discussed below. There are no legs in this embodiment to attach the sections of the fastener to the pieces of material. Rather, the sections of the fastener are attached by the Kwik-rivet connectors. The rivet cap 210 may have a decorative surface or embossing.

Magnetic ring 213 is held adjacent to first side 207*a* of first base washer 207 by non-magnetic cover 215, which has a top 215*a* and a side wall 215*b*. Flange 215*c* helps contain magnetic ring 213 in place within the cover 215 and continuous flange 215*d* holds the cover in place relative to base washer 207. Magnetic ring 213 is toroidal in shape and has a central hole 213*a* larger than the outside diameter of the wide diameter section 209*a* of tubular stem 209. In this embodiment, tubular stem 209 and non-magnetic cover 215 have central holes 209*d* and 215*e*, respectively, which are substantially axially aligned with hole 207*c* of base washer 207 and corresponding hole 208*c* of first base plate 208.

Turning now to male sections 205 of magnetic snap fastener 201, it is seen that second tubular stem 219, including wide section 219*a*, medium section 219*b*, and narrow section 219*c*, is insertable through a corresponding hole 221*a* of second base plate 221 in a manner similar to that used in connection with each female section 203. Here again, in this embodiment, second tubular stem 219 has a central hole 219*d* that is substantially axially aligned with central hole 221*a* of second base plate 221. Moreover, as described in connection with female sections 203, the distal end of narrow diameter section 219*c* extends outward from second base plate 221 to engage second rivet cap 223, as shown more clearly in FIG. 14 and as discussed below.

FIG. 14 shows one male section 205 attached to a piece of material 225 held between second base plate 221 and second rivet cap 223. As seen in FIGS. 13 and 14, tubular stem 219 has a collapsible bump that is deformed by attachment of the second rivet cap 223 to cause the distal end of the tubular stem 219 to lock to the inside to the inside of the second rivet cap 223 to hold material 225. Each female section 203 is attached to a piece of material in a similar manner.

FIGS. 15*a* and 15*b* show a top view and a side cut-away view, respectively, of the magnetic ring 213. FIGS. 16*a* and 16*b* show a top view and a side cut-away view, respectively, of the base washer 207. FIGS. 16*c* and 16*d* show a top view and a side cut-away view, respectively, of both the first and second base plates 208 and 221. FIGS. 17*a* and 17*b* show a top view and a side cut-away view, respectively, of the non-magnetic cover 215. FIGS. 18*a* and 18*b* show a top view and a side cut-away view, respectively, of both the tubular stems 209 and 219. Several of these components are identical on the male and female sides for the reasons previously discussed.

Figure 19:
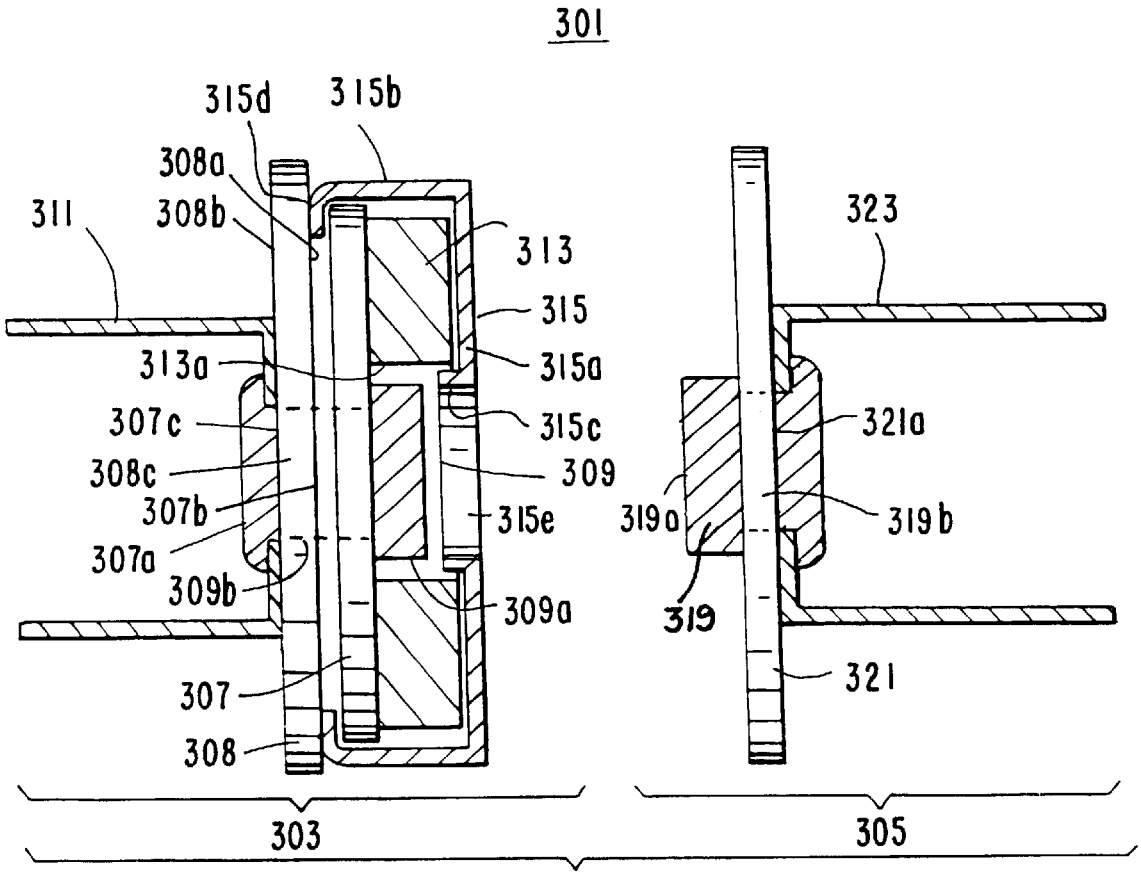
FIG. 19 is a cross-sectional view of one female section and one male section of still another embodiment of the instant invention.

In still another preferred embodiment of the present invention, each male section and each female section comprises solid stems instead of tubular stems. Although not shown, the stems may also be partially hollow. Referring to FIG. 19, one female section 303 and one male section 305 of this preferred embodiment of magnetic snap fastener 301 are shown separated from one another. Each female section 303 and each male section 305 is adapted so that any female section 303 and any male section 305 may mate to form a complete snap fastener.

Each female section 303 includes a base washer 307 with first side 307*a*, opposite facing second side 307*b* and central hole 307*c*. A first base plate 308 has a first side 308*a* and a second side 308*b*, and for each female section 303 attached to first base plate 308, there is a corresponding hole 308*c* through base plate 308 substantially axially aligned with central hole 307*c* of that particular female section 303. Solid stem 309 is circular in cross section and has a wide diameter section 309*a* and a narrow diameter section 309*b*. Solid stem 309 may be inserted into the central hole 307*c* from base washer first side 307*a* and into the corresponding hole 308*c* in first base plate 308 from base plate first side 308*a*. The distal end of the narrow diameter section 309*b* is flattened to widen the portion of narrow diameter section 309*b* that protrudes from second side 308*b* of first base washer 308 and thereby affix first side 308*a* of first base plate 308 adjacent to the second side 307*b* of base washer 307, separated only by the width of continuous flange 315*d* described below, and attachment legs 311 adjacent to second side 308*b* of base plate 308. Desirably, the legs 311 are not rigidly secured with respect to base washer 307.

Magnetic ring 313 is held adjacent to first side 307*a* of base washer 307 by non-magnetic cover 315, which has a top 315*a* and a side wall 315*b*. Flange 315*c* helps contain magnetic ring 313 in place within the cover 315 and continuous flange 315*d* holds the cover in place relative to base washer 307. Magnetic ring 313 is toroidal in shape and has a central hole 313*a* larger than the outside diameter of the wide diameter section 309*a* of solid stem 309. Solid stem 309 is substantially axially aligned with central hole 315*e* of non-magnetic cover 315, hole 307*c* of base washer 307 and corresponding hole 308*c* of first base plate 308.

Turning now to male sections 305 of magnetic snap fastener 301, it is seen that second solid stem 319, including wide section 319*a* and narrow section 319*b*, connects second base plate 321 to attachment legs 323 in a manner similar to that used in connection with each female section 303. Here again, second solid stem 319 is substantially axially aligned with corresponding hole 321*a* of second base plate 321. The attachment legs 323 desirably are not rigidly secured.

FIGS. 20*a* and 20*b* show a top view and a side cut-away view, respectively, of the magnetic ring 313. FIGS. 21*a* and 21*b* show a top view and a side cut-away view, respectively, of the base washer 307. FIGS. 21*c* and 21*d* show a top view and a side cut-away view, respectively, of both the first and second base plates 308 and 321. FIGS. 22*a* and 22*b* show a top view and side cut-away view, respectively, of the non-magnetic cover 315. FIGS. 23*a* and 23*b* show a top view and a side cut-away view, respectively, of both the solid stems 309 and 319. Once again, several of these components are identical on the male and female sides so as to provide for easy assembly and to reduce the cost of the finished product. This embodiment of the invention alternatively may comprise either type of attachment means employed in connection with the embodiments described above, e.g., rolled rivets or Kwik-rivet connectors, instead of legs, to attach the fastener to pieces of material.

Figure 24A:
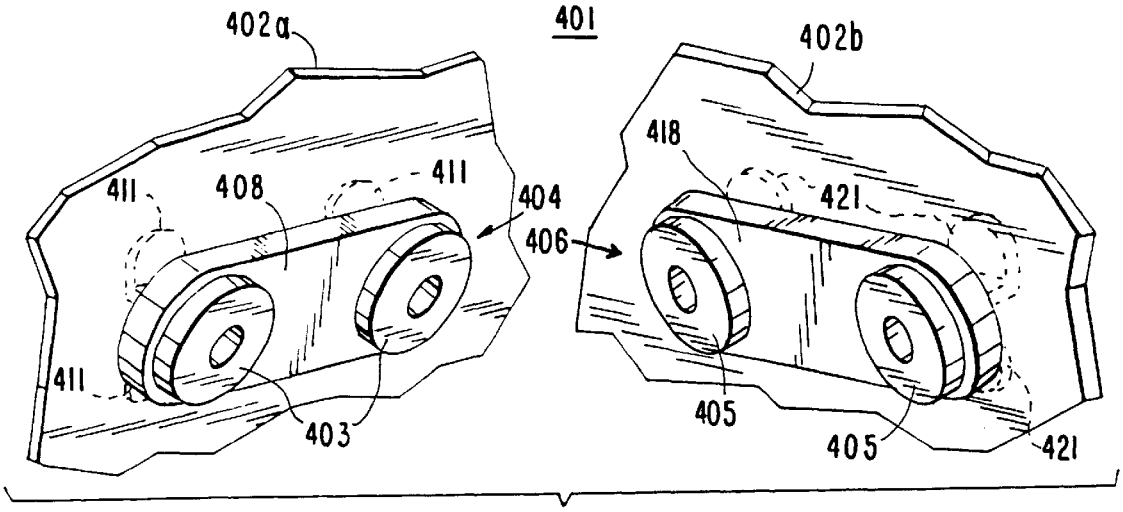
FIG. 24*a* is a perspective view showing yet another embodiment of the instant invention, having two positive sections and two negative sections, in open position.

Yet another preferred embodiment of the present invention comprises a positive fastener and a negative fastener, each of which comprises one or more magnetic sections. FIG. 24*a* is a perspective drawing of one positive fastener 404 comprising multiple positive magnetic sections 403, and one negative fastener 406 comprising multiple negative magnetic sections 405. Alternatively, the invention comprises multiple positive magnetic sections and one negative magnetic section, or multiple negative magnetic sections and one positive magnetic section. If more than one of each of the positive magnetic sections 403 and negative magnetic sections 405 are used, the distance between each consecutive pair of positive sections 403 preferably is equal, and the distance between each consecutive pair of negative sections 405 preferably is equal to the distance between each of consecutive pair of positive sections 403.

Figure 24B:
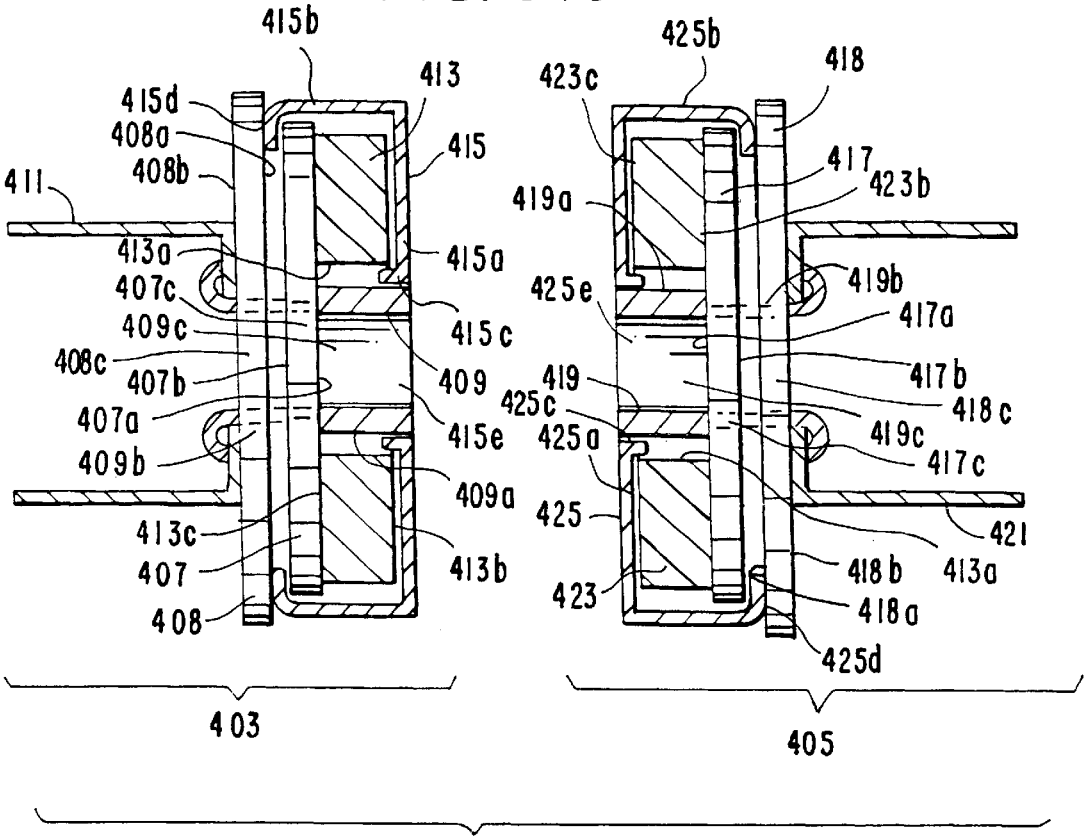
FIG. 24*b* is a cross-sectional view of one positive section and one negative section of the embodiment of FIG. 24*a;*

FIG. 24*b* shows one positive magnetic section 403 and one negative magnetic section 405 of this preferred embodiment of magnetic snap fastener 401. Each positive section 403 is attracted to each negative section 405.

Each positive section 403 includes a first base washer 407 with first side 407*a*, opposite facing second side 407*b* and central hole 407*c*. First base plate 408 has a first side 408*a* and a second side 408*b*, and for each positive section 403 attached to first base plate 408, there is a corresponding hole 408*c* through base plate 408 substantially axially aligned with central hole 407*c* of that particular positive section 403. First tubular stem 409 is circular in cross-section and has a central hole 409*c*. Tubular stem 409 may be solid, hollow or partially hollow. Tubular stem 409 also has a wide diameter section 409*a* and a narrow diameter section 409*b* and is insertable into the hole 407*c* in first base washer 407 from base washer first side 407*a*, and also is insertable into the corresponding hole 408*c* in first base plate 408 from base plate first side 408*a*. The distal end of the narrow diameter section 409*b* is rolled over to affix first side 408*a* of first base plate 408 adjacent to the second side 407*b* of first base washer 407, separated only by the width of continuous flange 415*d* described below, and attachment legs 411 adjacent to second side 408*b* of first base plate 408. Desirably, the legs 411 are not rigidly secured.

First magnetic ring 413 is toroidal in shape and has a central hole 413*a* larger than the outside diameter of the wide diameter section 409*a* of first tubular stem 409. First magnetic ring 413 has positively poled side 413*b* and negatively poled side 413*c*. Negatively poled side 413*c* of magnetic ring 413 is held adjacent to first side 407*a* of first base washer 407 by first non-magnetic cover 415, which has a top 415*a* and a side wall 415*b*. Flange 415*c* helps contain first magnetic ring 413 in place within the cover 415 and continuous flange 415*d* holds the cover in place relative to first base washer 407. Since first tubular stem 409 and first non-magnetic cover 415 have central holes 409*c* and 415*e*, respectively, they are substantially axially aligned with central hole 407*c* of first base washer 407 and corresponding hole 408*c* of first base plate 408.

Each negative section 405 includes a second base washer 417 with first side 417*a*, opposite facing second side 417*b* and central hole 417*c*. Second base plate 418 has a first side 418*a* and a second side 418*b*, and for each negative section 405 attached to second base plate 418, there is a corresponding hole 418*c* through base plate 418 substantially axially aligned with central hole 417*c* of that particular negative section 405. Second tubular stem 419 is circular in cross-section and has a central hole 419*c*. Of course, tubular stem 419 may be solid, hollow or partially hollow. Tubular stem 419 also has a wide diameter section 419*a* and a narrow diameter section 419*b* and is insertable into the hole 417*c* in second base washer 417 from base washer first side 417*a*, and also is insertable into the corresponding hole 418*c* in second base plate 418 from base plate first side 418*a*. The distal end of the narrow diameter section 419*b* is rolled over to affix first side 418*a* of second base plate 418 adjacent to the second side 417*b* of second base washer 417, separated only by the width of continuous flange 425*d* described below, and attachment legs 421 adjacent to second side 418*b* of second base plate 418. The legs 421 desirably are not rigidly secured to second base washer 417.

Second magnetic ring 423 is toroidal in shape and has a central hole 413*a* larger than the outside diameter of the wide diameter section 419*a* of second tubular stem 419. Second magnetic ring 423 has positively poled side 423*b* and negatively poled side 423*c*. Positively poled side 423*b* of magnetic ring 423 is held adjacent to first side 417*a* of second base washer 417 by second non-magnetic cover 425, which has a top 425*a* and a side wall 425*b*. Flange 425*c* helps contain second magnetic ring 423 in place within the cover 425 and continuous flange 425*d* holds the cover in place relative to second base washer 417. Since second tubular stem 419 and second non-magnetic cover 425 have central holes 419*c* and 425*e*, respectively, they are substantially axially aligned with central hole 417*c* of second base washer 417 and corresponding hole 418*c* of second base plate 418.

The only difference between each positive magnetic section 403 and each negative magnetic section 405 is the orientation of the magnetic rings 413 and 423. Therefore, when positive fastener 404 is brought into close proximity with negative fastener 406, the positively poled side 413*b* of one or more magnetic sections 403 is magnetically attracted to the negatively poled side 423*c* of one or more magnetic sections 405, and positive fastener 404 and negative fastener 406 thus are joined. The fasteners may be joined at any position at which the top 415*a* of at least one first non-magnetic cover 415 is in full contact with the top 425*a* of at least one second non-magnetic cover 425. Of course, the terms positive and negative are relative, as the faces of the magnets have opposite polarity.

Legs 411 and 421 may, of course, be attached to two respective pieces of material 402*a* and 402*b*. Thus, the two pieces of material 402*a* and 402*b* are attached when one positive section 403 and one negative section 405 are joined.

FIGS. 25*a* and 25*b* show a top view and a side cut-away view, respectively, of magnetic rings 413 and 423. FIGS. 26*a* and 26*b* show a top view and a side cut-away view, respectively, of base washers 407 and 417. FIGS. 26*c* and 26*d* show a top view and a side cut-away view, respectively, of base plates 408 and 418. FIGS. 27*a* and 27*b* show a top view and a side cut-away view, respectively, of non-magnetic covers 415 and 425. FIGS. 28*a* and 28*b* show a top view and side cut-away view, respectively, of tubular stems 409 and 419.

It is a particular feature of this embodiment of the invention that all parts, except in some instances the base plates 408 and 418, are identical on both the positive and negative magnetic sections of the fastener. If the number of female sections is equal to the number of male sections, both base plates also are identical. This reduces the number of different parts needed to make a complete assembly.

Figure 29:
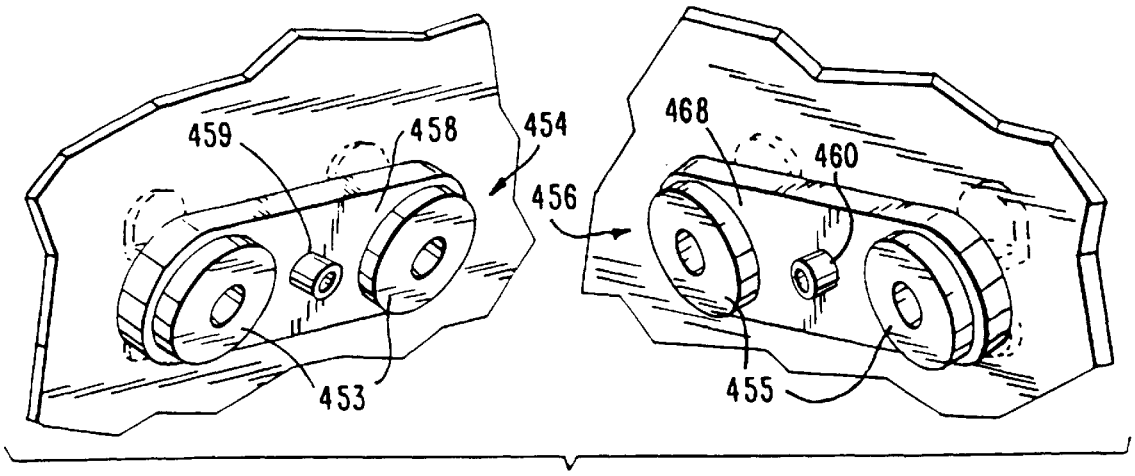
FIG. 29 is a perspective view showing an alternative version of the embodiment of FIG. 24*a* having supplemental tubular stems between each of two positive sections and two negative sections.

FIG. 29 shows an alternative version of this embodiment of the invention. Supplemental tubular stems may be added between one or more adjacent pairs of positive magnetic sections or negative magnetic sections. In FIG. 29, positive fastener 454 contains one supplemental tubular stem 459 between adjacent positive magnetic sections 453, and negative fastener 456 contains one supplemental tubular stem 460 between adjacent magnetic sections 455.

Other than the addition of the supplemental tubular stems 459 and 460, positive fastener 454 is identical to positive fastener 404, and negative fastener 456 is identical to negative fastener 406. Supplemental tubular stems 459 and 460 are identical to tubular stems 409 and 419 and are attached to base plates 458 and 468 in the same manner that tubular stems 409 and 419 are attached to base plates 408 and 418, respectively. Supplemental tubular stems 459 and 460 may be solid, hollow or partially hollow. The attractive magnetic force between any positive magnetic section 453 and any supplemental tubular stem 460 of negative fastener 456, as well as the attractive magnetic force between any negative magnetic section 455 and any supplemental tubular stem 459 of positive fastener 454, allows positive fastener 454 and negative fastener 456 to be joined at intermediary positions, i.e., halfway between the centers of magnetic rings.

These embodiments of the invention, with or without the supplemental tubular stems, alternatively may comprise any of the attachment means described above, e.g., rolled rivets or Kwik-rivet connectors, instead of legs to attach the fastener to pieces of material.

In still another preferred embodiment of the present invention, again comprising female and male fasteners, instead of each female magnetic snap section having its own non-magnetic cover, one non-magnetic cover encases the entire female fastener.

Figure 30A:
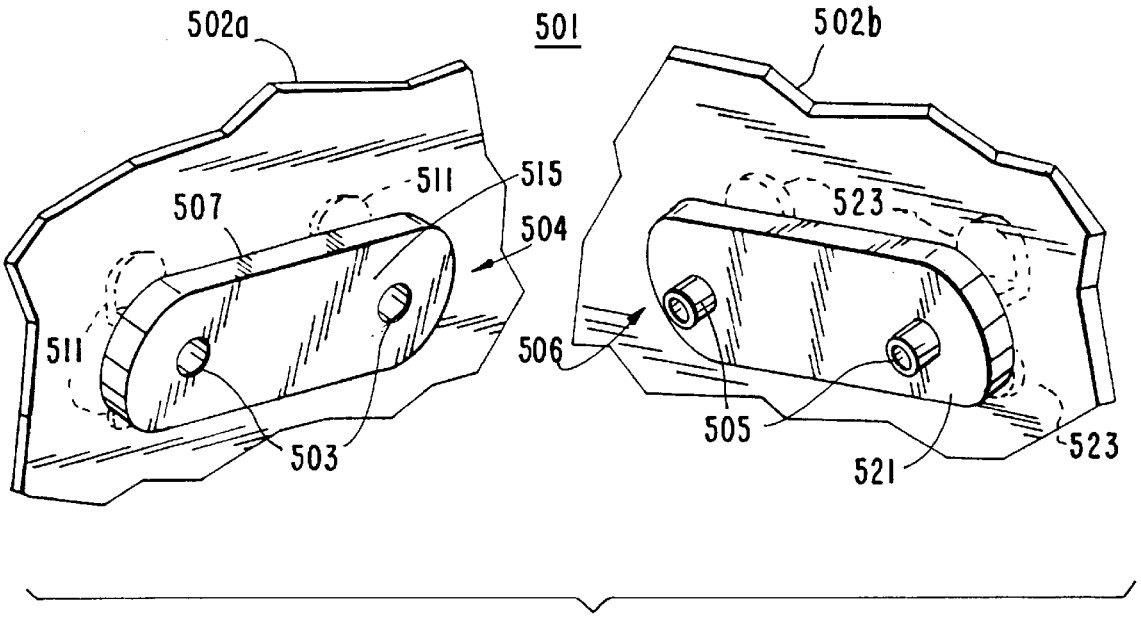
FIG. 30*a* is a perspective view showing still another embodiment of the instant invention, having two female sections and two male sections with one cover plate encasing all female sections, in an open position.
Figure 30B:
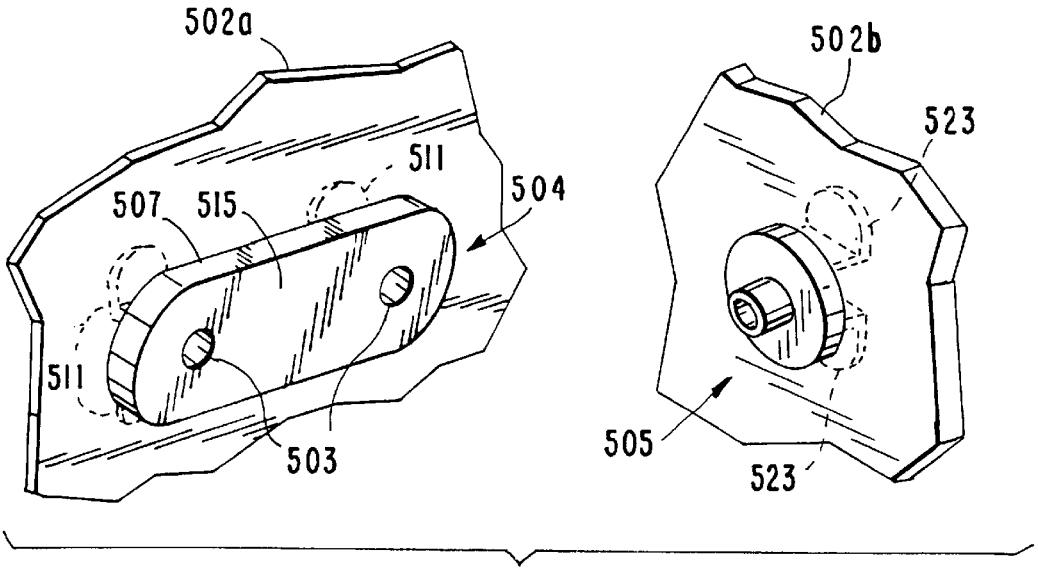
FIG. 30*b* is a perspective view showing an alternative version of the embodiment of FIG. 30*a* having multiple female sections and one male section.

FIG. 30*a* shows one version of this embodiment of the invention, in which a plurality of female sections 503 of an adjustable magnetic snap fastener 501 are attached to a first base plate 507 and covered by a non-magnetic cover 515 to form female fastener 504, which is attached to a first piece of material 502*a*, and a plurality of male sections 505 of an adjustable magnetic snap fastener 501 are attached to a second base plate 521 to form male fastener 506, which is attached to a second piece of material 502*b*. As shown in FIG. 30*b*, the invention alternatively may have multiple female sections 503 and one male section 505. The distance between each consecutive pair of female sections 503 preferably is equal, and the distance between each consecutive pair of male sections 505 preferably is equal to the distance between each pair of female sections 503.

Figure 30C:
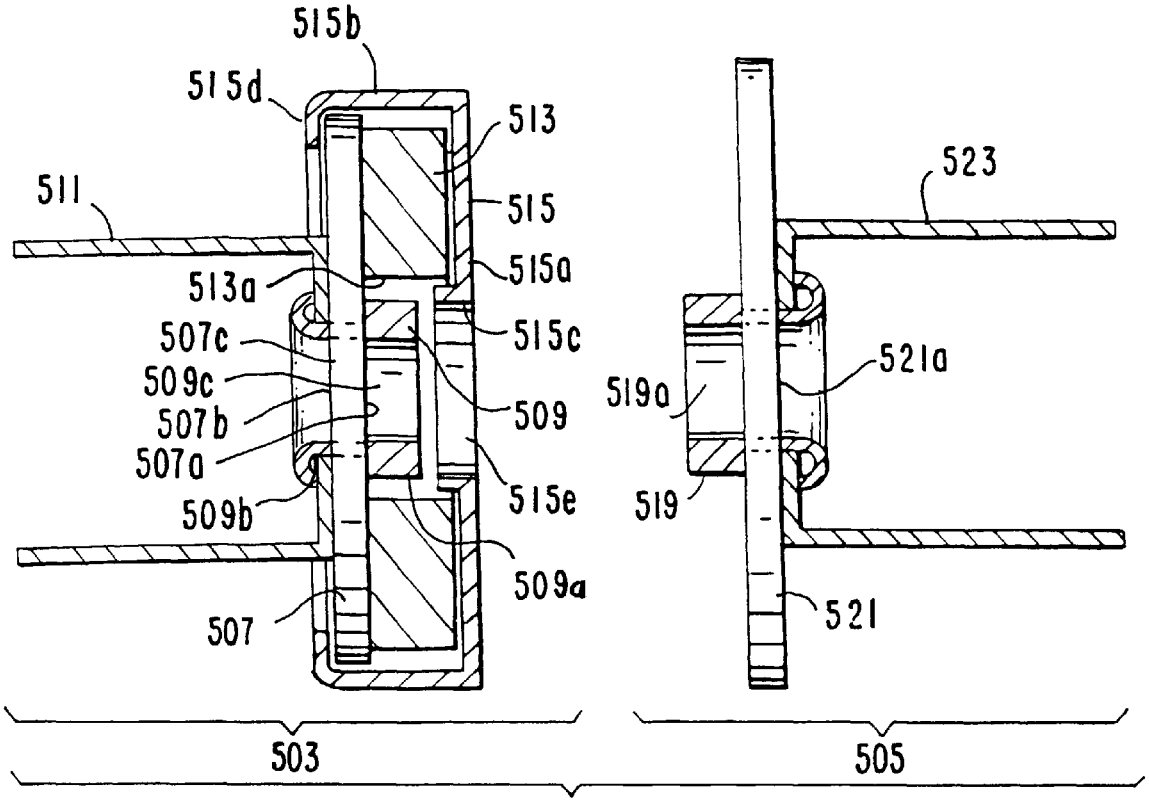
FIG. 30*c* is a cross-sectional view of one female section and one male section of the embodiment of FIG. 30*a;*

Referring to FIG. 30*c*, one female section 503 and one male section 505 of this preferred embodiment of magnetic snap fastener 501 are shown separated from one another. Each female section 503 and each male section 505 is adapted so that any female section 503 and any male section 505 may mate so as to form a complete fastener.

Each magnetic ring 513 of female fastener 504 is held adjacent to first side 507*a* of base plate 507 by non-magnetic cover 515, which has a top 515*a* and a side wall 515*b*. A plurality of flanges 515*c*, equal to the number of female sections 503, help contain magnetic rings 513 in place within the cover 515. Each flange 515*c* defines a central hole 515*e*. Continuous flange 515*d* holds the cover in place relative to base plate 507. desirably, continuous flange 515*d* is used to hold the cover 515 in place, because it is more secure than if discrete prongs or tabs are used to form a peripheral flange. Desirably also, flange 515*d* is continuous about the periphery of cover 515 so that the cover is not easily removable and lies flat against the piece of material. Magnetic ring 513 is toroidal in shape and has a central hole 513*a* larger than the outside diameter of the wide diameter section 509*a* of tubular stem 509. Central holes 509*c* and 515*e* of each tubular stem 509 and of non-magnetic cover 515, respectively, are substantially axially aligned with a corresponding hole 507*c* of first base plate 507.

Each magnetic ring 513 of female fastener 504 is held adjacent to first side 507*a* of base plate 507 by non-magnetic cover 515, which has a top 515*a* and a side wall 515*b*. A plurality of flanges 515*c*, equal to the number of female sections 503, help contain magnetic rings 513 in place within the cover 515. Each flange 515*c* defines a central hole 515*e*. Continuous flange 15*d* holds the cover in place relative to base plate 507. Desirably, continuous flange 515*d* is used to hold the cover 515 in place, because it is more secure than if discrete prongs or tabs are used to form a peripheral flange. Desirably also, flange 515*d* is continuous about the periphery of cover 515 so that the cover is not easily removable and lies flat against the piece of material. Magnetic ring 513 is toroidal in shape and has a central hole 513*a* larger than the outside diameter of the wide diameter section 509*a* of tubular stem 509. Central holes 509*c* and 515*e* of each tubular stem 509 and of non-magnetic cover 515, respectively, are substantially axially aligned with a corresponding hole 507*c* of first base plate 507.

Turning now to male sections 505 of magnetic snap fastener 501, it is seen that second tubular stem 519 connects second base plate 521 to attachment legs 523 in a manner similar to that used in connection with each female section 503. Here again, in this embodiment, second tubular stem 519 has a central hole 519*a* that is substantially axially aligned with a corresponding hole 521*a* of second base plate 521. The attachment legs 523 desirably are not rigidly secured so that they are rotatable with respect to second base plate 521.

As is clear from FIGS. 30*a* through 30*c*, second tubular stem 519 of one male section 505 is insertable into one hole 515*e* of non-magnetic cover 515 corresponding to one female section 503. Due to the force of the magnetic ring 513, the male section 505 and female section 503 snap together. Legs 511 and 523 may, of course, be attached to two respective pieces of material 502*a* and 502*b*. Thus, the two pieces of material 502*a* and 502*b* are attached when one female section 503 and one male section 505 are snapped together.

Figure 31A:
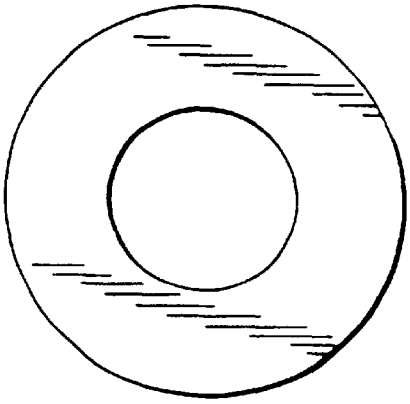
FIGS. 31*a* and 31*b* are a top view and a side cut-away view, respectively, of the magnetic ring of the embodiment of FIG. 30*a;*
Figure 31B:
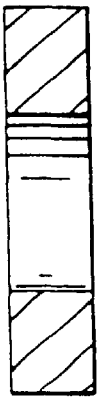

FIGS. 31*a* and 31*b* show a top view and a side cut-away view, respectively, of the magnetic ring 13. FIGS. 32*a* and 32*b* show a top view and a side cut-away view, respectively, of both the first and second base plates 507 and 521. FIGS. 33*a*, 33*b*, and 33*c* show side views and a plan view, respectively, of both the legs 511 and 523. FIGS. 34*a* and 34*b* show a top view and a side cut-away view, respectively, of the non-magnetic cover 515. FIGS. 35*a* and 35*b* show a top view and side cut-away view, respectively, of both the tubular stems 509 and 519. Again, the legs and tubular stems are identical on both the female and male sections of the fastener. If the number of female sections is equal to the number of male sections, both base plates also are identical. This reduces the number of different parts needed to make a complete assembly. The axially aligned holes in the components may serve as a distinguishing feature of products made in accordance with the invention.

Also as with other embodiments of the invention, each of the openings are in axial alignment. Thus, when a female section 503 and a male section 505 are magnetically attached to one another, central holes 509*c*, 513*a*, 515*e*, and 519*a* of the female section 503 and the male section 505, as well as corresponding holes 507*c* and 521*a* of base plates 507 and 521, form a straight path.

This embodiment of the invention alternatively may comprise any of the attachment means described above, e.g., rolled rivets or Kwik-rivet connectors, instead of legs to attach the fastener to pieces of material. Furthermore, the tubular stems may be replaced by solid stems.

Figure 36A:
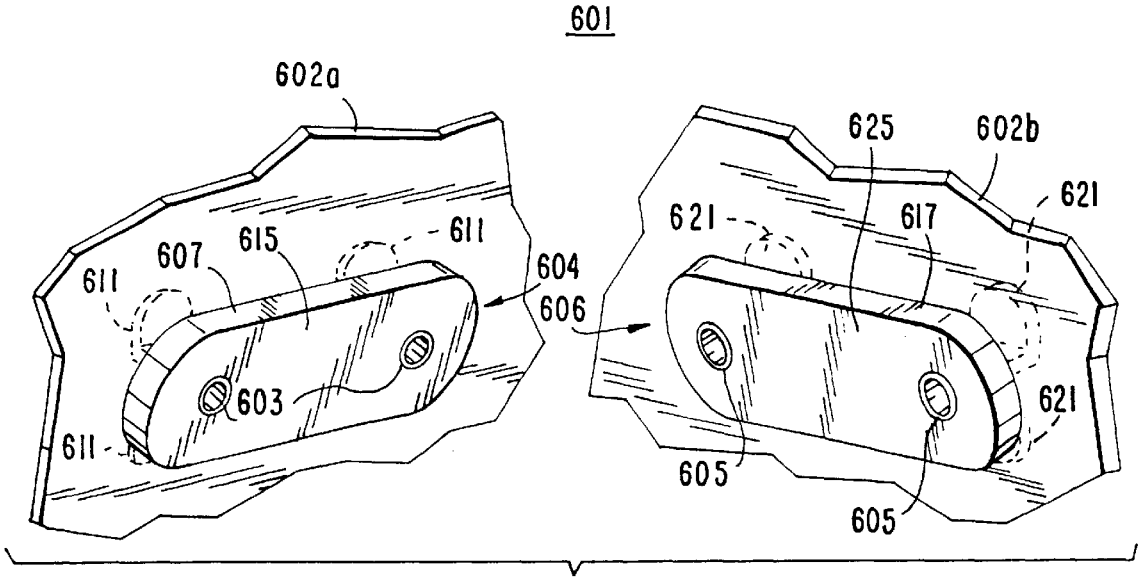
FIG. 36*a* is a perspective view showing yet another embodiment of the instant invention, having multiple positive sections encased in one cover plate and multiple negative sections encased in a second cover plate, in an open position.

Yet another preferred embodiment of the present invention comprises a positive fastener and a negative fastener, each of which comprises one or more magnetic sections; all of the positive magnetic sections are encased in one non-magnetic cover and all of the negative magnetic sections are encased in a second non-magnetic cover. FIG. 36*a* is a perspective drawing of one positive fastener 604 comprising multiple positive magnetic sections 603, and one negative fastener 606 comprising multiple negative magnetic sections 605. Alternatively, the invention comprises multiple positive magnetic sections and one negative magnetic section, or multiple negative magnetic sections and one positive magnetic section. If more than one of each of the positive magnetic sections 603 and negative magnetic sections 605 are used, the distance between each consecutive pair of positive sections 603 preferably is equal, and the distance between each consecutive pair of negative sections 605 preferably is equal to the distance between each of consecutive pair of positive sections 603.

Figure 36B:
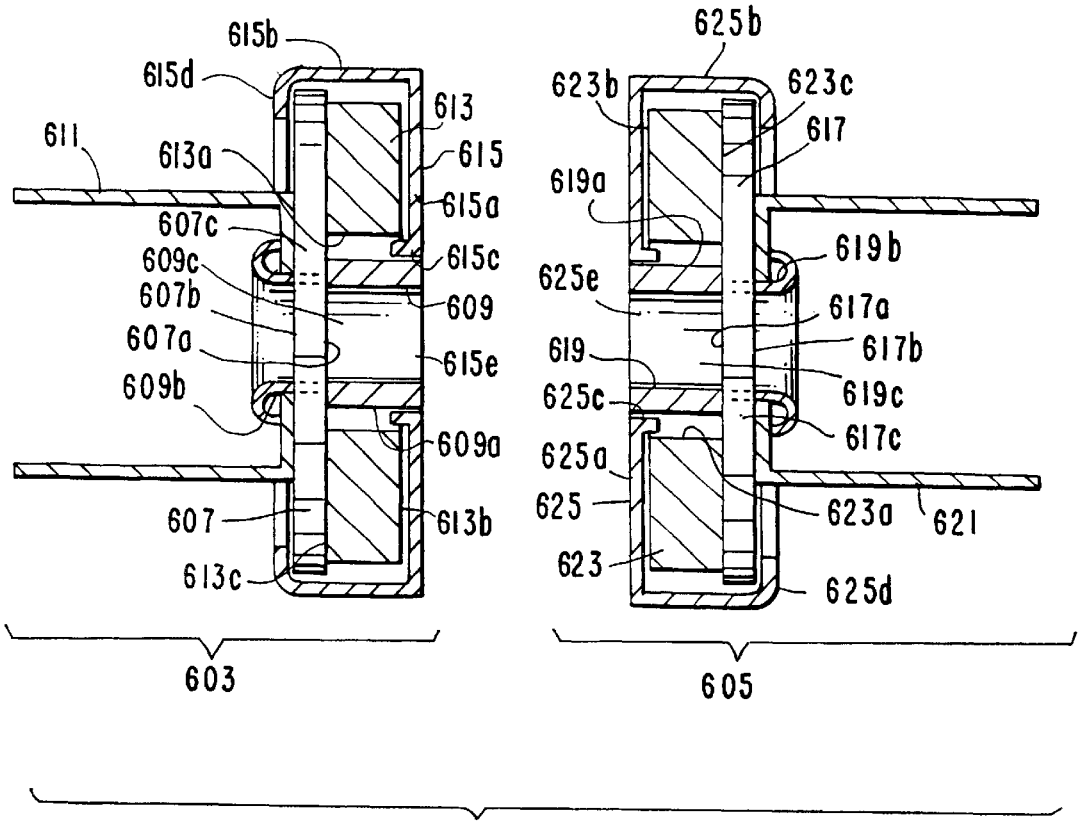
FIG. 36*b* is a cross-sectional view of one positive section and one negative section of the embodiment of FIG. 36*a;*

FIG. 36*b* shows one positive magnetic section 603 and one negative magnetic section 605 of this preferred embodiment of magnetic snap fastener 601. Each positive section 603 is attracted to each negative section 605.

Each positive section 603 is attached to a first base plate 607 having first side 607*a*, opposite facing second side 607*b* and a plurality of central holes 607*c*, the number of which is equal to the number of positive sections 603. Each positive section 603 has a first tubular stem 609, which is circular in cross-section and has a central hole 609*c*. Tubular stems 609 may be solid, hollow or partially hollow. Each tubular stem 609 also has a wide diameter section 609*a* and a narrow diameter section 609*b* and is insertable into corresponding hole 607*c* in first base plate 607 from base plate first side 607*a*. The distal end of the narrow diameter section 609*b* is rolled over to affix attachment legs 611 adjacent to second side 607*b* of first base plate 607. Desirably, the legs 611 are not rigidly secured.

Each positive section 603 also has a first magnetic ring 613, which is toroidal in shape and has a central hole 613*a* larger than the outside diameter of the wide diameter section 609*a* of corresponding first tubular stem 609. Each first magnetic ring 613 has positively poled side 613*b* and negatively poled side 613*c*. Negatively poled side 613*c* of magnetic ring 613 is held adjacent to first side 607*a* of first base plate 607 by first non-magnetic cover 615, which has a top 615*a* and a side wall 615*b*. A plurality of flanges 615*c*, equal to the number of positive sections 603, help contain first magnetic rings 613 in place within the cover 615. Each flange 615*c* defines a central hole 615*e*. Continuous flange 615*d* holds the cover in place relative to first base plate 607. Central holes 609*c* and 615*e* of each tubular stem 609 and of non-magnetic cover 615, respectively, are substantially axially aligned with a corresponding hole 607*c* of first base plate 607.

Each negative section 605 also has a second magnetic ring 623, which is toroidal in shape and has a central hole 623*a* larger than the outside diameter of the wide diameter section 619*a* of corresponding second tubular stem 619. Each second magnetic ring 623 has positively poled side 623*b* and negatively poled side 623*c*. Positively poled side 623*b* of magnetic ring 623 is held adjacent to first side 617*a* of second base plate 617 by second non-magnetic cover 625, which has a top 625*a* and a side wall 625*b*. A plurality of flanges 625*c*, equal to the number of negative sections 605, help contain second magnetic rings 623 in place within the cover 625. Each flange 625*c* defines a central hole 625*e*. Continuous flange 625*d* holds the cover in place relative to second base plate 617. Central holes 619*c* and 625*e* of each second tubular stem 619 and of second non-magnetic cover 625, respectively, are substantially axially aligned with a corresponding hole 617*c* of second base plate 617.

Each negative section 605 also has a second magnetic ring 623, which is toroidal in shape and has a central hole 623*a* larger than the outside diameter of the wide diameter section 619*a* of corresponding second tubular stem 619. Each second magnetic ring 623 has positively charged side 623*b* and negatively charged side 623*c*. Positively charged side 623*b* of magnetic ring 623 is held adjacent to first side 617*a* of second base plate 617 by second non-magnetic cover 625, which has a top 625*a* and a side wall 625*b*. A plurality of flanges 625*c*, equal to the number of negative sections 605, help contain second magnetic rings 623 in place within the cover 625. Each flange 625*c* defines a central hole 625*e*. Continuous flange 625*d* holds the cover in place relative to second base plate 617. Central holes 619*c* and 625*e* of each second tubular stem 619 and of second non-magnetic cover 625, respectively, are substantially axially aligned with a corresponding hole 617*c* of second base plate 617.

The only difference between each positive magnetic section 603 and each negative magnetic section 605 is the orientation of the magnetic rings 613 and 623. Therefore, when positive fastener 604 is brought into close proximity with negative fastener 606, the positively poled side 613*b* of one or more magnetic sections 603 is magnetically attracted to the negatively poled side 623*c* of one or more magnetic sections 605, and positive fastener 604 and negative fastener 606 thus are joined. Of course, the terms positive and negative are relative, as the faces of the magnets have opposite polarity.

Legs 611 and 621 may, of course, be attached to two respective pieces of material 602*a* and 602*b*. Thus, the two pieces of material 602*a* and 602*b* are attached when one positive section 603 and one negative section 605 are joined.

FIGS. 37*a* and 37*b* show a top view and a side cut-away view, respectively, of magnetic rings 613 and 623. FIGS. 38*a* and 38*b* show a top view and a side cut-away view, respectively, of base plates 607 and 617. FIGS. 39*a* and 39*b* show a top view and a side cut-away view, respectively, of non-magnetic covers 615 and 625. FIGS. 40*a* and 40*b* show a top view and side cut-away view, respectively, of tubular stems 609 and 619.

It is a particular feature of this embodiment of the invention that all parts, except in some instances the base plates 607 and 617 and non-magnetic covers 615 and 625, are identical on both the positive and negative magnetic sections of the fastener. If the number of female sections is equal to the number of male sections, both base plates and both non-magnetic covers also are identical. This reduces the number of different parts needed to make a complete assembly.

This embodiment of the invention also may comprise supplemental tubular stems between one or more adjacent pairs of positive magnetic sections or negative magnetic sections, as described above. Furthermore, this embodiment alternatively may comprise any of the attachment means described above, e.g., rolled rivets or Kwik-rivet connectors, instead of legs to attach the fastener to pieces of material.

The invention has practical utility in adjustably fastening pieces of material such as straps for golf shoes, children's shoes, shoes for the elderly, bags, and the like.

The fasteners of the invention are easily finished such as by coating processes. In the embodiments having a hole through the rivet or stem of each male and female section, the closures may be threaded on a wire and rapidly processed. Additionally, when tubular stems are used, the fasteners may be easily assembled using automatic positioning devices because each part has a hole therethrough. For example, an infrared light source such as a laser alignment beam may be used to direct light through the holes to align the closures when they are being assembled in the manufacturing process, improving the quality of the parts, speeding assembly, and reducing cost. The axially aligned central holes do not substantially detract from the magnetic attractive force provided by the magnetic ring. However, to the extent the magnetic attractive force is reduced by the holes in the rivets or stems, a magnet of greater strength, such as a Neodymium-Iron-Boron magnet, may be used.

Although the present invention is described by reference to particular embodiments thereof, many changes and modifications of the invention may become apparent to those skilled in the art without departing from the spirit and scope of the invention, which is only limited by the appended claims. For example, instead of being attached to a base plate, each female section may be separately attached to the piece of material to be fastened, in which case the base plate simply is removed from the female fastener, and if legs are used to attach the female apparatus to the material, each pair of legs is attached directly to the base washer of one female section. Likewise, each male section may be separately attached to a piece of material, in which case the base plate is replaced by individual base washers in each male section, which may be identical to those used in each female section. Also, instead of the base plates being visible when the female fastener and/or male fastener are attached to the material, they may be embedded between two layers of the material so that only the non-magnetic covers of the female sections and the tubular stems of the male sections are visible. Furthermore, the tubular or solid stems may be replaced by hollow stems that are open at one end, that is, they are partially hollow but not solid. Also, the non-magnetic covers may be held in place relative to the base washers or base plates by discrete prongs or tabs instead of continuous flanges. Moreover, not every male and female or positive and negative section must have attachment means such as legs or rivets to attach the fasteners to pieces of material; instead, as few as one attachment means is required on each fastener portion. In addition, the male and female portions may be square or another shape and need not be circular as shown. Therefore, the embodiments shown and described are only illustrative, not restrictive.

What is claimed is:

1. An adjustable magnetic snap fastener for releasably connecting a first surface and a second surface, comprising:

(a) a plurality of female sections, each female section having a first base washer defining a first hole substantially in the center of the first base washer;

a magnetic ring defining a second hole substantially in the center of the magnetic ring;

a non-magnetic cover plate defining a third hole substantially in the center of the cover plate and having a peripheral flange, the cover plate being mounted to the first base washer by the peripheral flange whereby the magnetic ring is held between the first base washer and the cover plate and whereby the first, second, and third holes are substantially axially aligned; and a first stem extending through the first and second holes;

(b) a plurality of male sections, each male section having a second base washer defining a fourth hole substantially in the center of the second base washer; and a second stem extending through the fourth hole;

(c) a first base plate having a firs: side and a second side;

(d) a second base plate having a first side and a second side;

(e) wherein the peripheral flange of each female section engages the first side of the first base plate and each first attachment means is connected to the second side of the first base plate;

(f) wherein the second base washer of each male section engages the first side of the second base plate and each second attachment means is connected to the second side of the second base plate;

(g) wherein at least one of the plurality of female sections has a first attachment means connected to the first base washer of said female section by the first stem of said female section and adapted for attachment to the first surface, and at least one of the plurality of male sections has a second attachment means connected to the second base washer of said male section by the second stem of said male section and adapted for attachment to the second surface;

(h) wherein at least one of the plurality of female sections is attached to the first surface and all of the female sections are arranged in substantially a straight line, and at least one of the plurality of male sections is attached to the second surface and all of the male sections are arranged in substantially a straight line; and (i) whereby insertion of the second stem of one of the plurality of male sections into at least the second and third holes of one of the plurality of female sections creates a magnetic force which releasably connects said one female section and said one male section and hence the first and second surfaces attached to the first and second attachment means, respectively.

2. The adjustable magnetic snap fastener of claim 1, wherein the first base plate defines a plurality of first plate holes whereby the first stem of each female section extends through a corresponding one of the plurality of first plate holes and the first, second, and third holes of each female section are substantially axially aligned with the corresponding first plate hole, and the second base plate defines a plurality of second plate holes whereby the second stem of each male section extends through a corresponding one of the plurality of second plate holes and the fourth hole of each male section is substantially axially aligned with the corresponding second plate hole.

3. The adjustable magnetic snap fastener of claim 1, wherein the first stem of at least one of the plurality of female sections has a first stem hole substantially in the center thereof and the second stem of at least one of the plurality of male sections has a second stem hole substantially in the center thereof.

4. An adjustable magnetic snap fastener for releasably connecting a first surface and a second surface, comprising:

(a) a plurality of female sections, each female section comprising a magnetic ring defining a first hole substantially in the center of the magnetic ring and a first stem extending through the first hole;

(b) a first base plate having a first side and a second side and defining a plurality of first base plate holes, wherein the magnetic ring of each female section engages the first side of the first base plate and the first stem of each female section extends through one of the plurality of first base plate holes;

(c) a non-magnetic cover plate defining a plurality of cover plate holes and having a peripheral flange, the cover plate being mounted to the first base plate by the peripheral flange whereby each of the magnetic rings is held between the first base plate and the cover plate and whereby the first hole and the first stem of each female section are substantially axially aligned with a corresponding first base plate hole and a corresponding cover plate hole;

(d) a plurality of male sections, each male section comprising a second stem;

(e) a second base plate having a first side and a second side and defining a plurality of second base plate holes, wherein the second stem of each male section extends through one of the plurality of second base plate holes;

(f) wherein at least one of the plurality of female sections has a first attachment means connected to the first base plate by the first stem of said female section and adapted for attachment to the first surface, and at least one of the plurality of male sections has a second attachment means connected to the second base plate by the second stem of said male section and adapted for attachment to the second surface;

(g) wherein the first base plate is attached to the first surface by at least one first attachment means, and the second base plate is attached to the second surface by at least one of the second attachment means; and (h) whereby insertion of the second stem of one of the plurality of male sections into at least the first hole of one of the plurality of female sections creates a magnetic force which releasably connects said one female section and said one male section and hence the first and second surfaces attached to the first and second attachment means, respectively.

5. The adjustable magnetic snap fastener of claim 4, wherein each first attachment means comprises a first pair of legs, and each second attachment means comprises a second pair of legs.

6. The adjustable magnetic snap fastener of claim 5, wherein each first pair of legs is mounted to the first base plate by the first stem of one of said female sections, and each second pair of legs is mounted to the second base plate by the second stem of one of said male sections.

7. The adjustable magnetic snap fastener of claim 4, wherein each first attachment means comprises a first attachment washer connectible to the first stem of one of said female sections, whereby the first surface is held between the first attachment washer and the first base plate, and each second attachment means comprises a second attachment washer connectible to the second stem of one of said male sections, whereby the second surface is held between the second attachment washer and the second base plate.

8. The adjustable magnetic snap fastener of claim 4, wherein each first attachment means comprises a first rivet cap connectible to a collapsible section of the first stem of one of said female sections, whereby the first surface is held between the first rivet cap and the first base plate, and each second attachment means comprises a second rivet cap connectible to a collapsible section of the second stem of one of said male sections, whereby the second surface is held between the second rivet cap and the second base plate.

9. The adjustable magnetic snap fastener of claim 4, wherein the first stem of at least one of the plurality of female sections has a first stem hole substantially in the center thereof and the second stem of at least one of the plurality of male sections has a second stem hole substantially in the center thereof.

10. An adjustable magnetic snap fastener for releasably connecting a first surface and a second surface, comprising:

(a) a plurality of female sections, each female section having a first base washer defining a first hole substantially in the center of the first base washer;

a magnetic ring defining a second hole substantially in the center of the magnetic ring;

a non-magnetic cover plate defining a third hole substantially in the center of the cover plate and having a peripheral flange, the cover plate being mounted to the first base washer by the peripheral flange whereby the magnetic ring is held between the first base washer and the cover plate and whereby the first, second, and third holes are substantially axially aligned; and a first stem extending through the first and second holes;

(b) a male section having a second base washer defining a fourth hole substantially in the center of the second base washer; and a second stem extending through the fourth hole;

(c) a first base plate having a first side and a second side;

(d) wherein the peripheral flange of each female section is positioned adjacent to the first side of the first base plate and each first attachment means is connected to the second side of the first base plate;

(e) wherein at least one of the plurality of female sections has a first attachment means connected to the first base washer of said female section by the first stem of said female section and adapted for attachment to the first surface, and the male section has a second attachment means connected to the second base washer by the second stem and adapted for attachment to the second surface;

(f) wherein at least one of the plurality of female sections is attached to the first surface, and the male section is attached to the second surface; and (g) whereby insertion of the second stem of the male section into at least the second and third holes of one of the plurality of female sections creates a magnetic force which releasably connects said one female section and said male section and hence the first and second surfaces attached to the first and second attachment means, respectively.

11. The adjustable magnetic snap fastener of claim 10, wherein the first base plate defines a plurality of first plate holes whereby the first stem of each female section extends through a corresponding one of the plurality of first plate holes and the first, second, and third holes of each female section are substantially axially aligned with the corresponding first plate hole.

12. An adjustable magnetic snap fastener for releasably connecting a first surface and a second surface, comprising:

(a) a plurality of female sections, each female section having a magnetic ring defining a first hole substantially in the center of the magnetic ring and a first stem extending through the first hole;

(b) a base plate having a first side and a second side and defining a plurality of base plate holes, wherein the magnetic ring of each female section engages the first side of the base plate and the first stem of each female section extends through one of the plurality of base plate holes;

(c) a non-magnetic cover plate defining a plurality of cover plate holes and having a peripheral flange, the cover plate being mounted to the base plate by the peripheral flange whereby each of the magnetic rings is held between the base plate and the cover plate and whereby the first hole and the first stem of each female section are substantially axially aligned with a corresponding base plate hole and a corresponding cover plate hole;

(d) a male section comprising a base washer defining a second hole substantially in the center of the base washer and a second stem extending through the second hole;

(e) wherein at least one of the plurality of female sections has a first attachment means connected to the base plate by the first stem of said female section and adapted for attachment to the first surface, and the male section has a second attachment means connected to the base washer by the second stem and adapted for attachment to the second surface;

(f) wherein the base plate is attached to the first surface by at least one first attachment means, and the base washer is attached to the second surface by the second attachment means; and (g) whereby insertion of the second stem of the male section into at least the first hole of one of the plurality of female sections creates a magnetic force which releasably connects said one female section and said male section and hence the first and second surfaces attached to the first and second attachment means, respectively.

13. A female portion of an adjustable magnetic snap fastener for releasably connecting a first surface to which the female portion of the adjustable magnetic snap fastener is attached and a second surface to which a male section of the adjustable magnetic snap fastener is attached, comprising a plurality of female sections, each female section comprising:

a base washer defining a first hole substantially in the center of the base washer;

a magnetic ring defining a second hole substantially in the center of the magnetic ring;

a non-magnetic cover plate defining a third hole substantially in the center of the cover plate and having a peripheral flange, the cover plate being mounted to the base washer by the peripheral flange whereby the magnetic ring is held between the base washer and the cover plate and whereby the first, second, and third holes are substantially axially aligned; and a stem extending through the first and second holes; wherein at least one of the plurality of female sections has an attachment means affixed to the base washer of that female section by the stem of that female section and adapted for attachment to the first surface;

a base plate having a first side and a second side;

wherein the peripheral flange of each female section is positioned adjacent to the first side of the base plate and each attachment means is connected to the second side of the base plate;

wherein at least one of the plurality of female sections is attached to the first surface and all of the female sections are arranged in substantially a straight line; and whereby insertion of the male section of the adjustable magnetic snap fastener into at least the second and third holes of one of the plurality of female sections creates a magnetic force which releasably connects said one female section and said male section and hence the first surface attached to the attachment means of the female portion of the adjustable magnetic snap fastener and the second surface attached to the male section of the magnetic snap fastener.

14. The female portion of the adjustable magnetic snap fastener of claim 13, wherein the base plate defines a plurality of plate holes whereby the stem of each female section extends through a corresponding one of the plurality of plate holes and the first, second, and third holes of each female section are substantially axially aligned with the corresponding plate hole.

15. The female portion of the adjustable magnetic snap fastener of claim 13, wherein the stem of at least one of the plurality of female sections has a stem hole substantially in the center thereof.

16. A female portion of an adjustable magnetic snap fastener for releasably connecting a first surface to which the female portion of the adjustable magnetic snap fastener is attached and a second surface to which a male section of the adjustable magnetic snap fastener is attached, comprising:

(a) a plurality of female sections, each female section comprising a magnetic ring defining a first hole substantially in the center of the magnetic ring and a stem extending through the first hole;

(b) a base plate having a first side and a second side and defining a plurality of base plate holes, wherein the magnetic ring of each female section engages the first side of the base plate and the stem of each female section extends through one of the plurality of base plate holes;

(c) a non-magnetic cover plate defining a plurality of cover plate holes and having a peripheral flange, the cover plate being mounted to the base plate by the peripheral flange whereby each of the magnetic rings is held between the base plate and the cover plate and whereby the first hole and the stem of each female section are substantially axially aligned with a corresponding base plate hole and a corresponding cover plate hole;

(d) wherein at least one of the plurality of female sections has an attachment means connected to the base plate by the stem of said female section and adapted for attachment to the first surface;

(e) wherein the first base plate is attached to the first surface by at least one of the attachment means; and (f) whereby insertion of the male section of the adjustable magnetic snap fastener into at least the first hole of one of the plurality of female sections creates a magnetic force which releasably connects said one female section and said male section and hence the first surface attached to the attachment means of the female portion of the adjustable magnetic snap fastener and the second surface attached to the male section of the magnetic snap fastener.

17. The female portion of the adjustable magnetic snap fastener of claim 16, wherein each attachment means comprises a pair of legs.

18. The female portion of the adjustable magnetic snap fastener of claim 17, wherein each pair of legs is mounted to the base plate by the stem of one of said female sections.

19. The female portion of the adjustable magnetic snap fastener of claim 16, wherein each attachment means comprises an attachment washer connectible to the stem of one of said female sections, whereby the first surface is held between the attachment washer and the base plate.

20. The female portion of the adjustable magnetic snap fastener of claim 16, wherein each attachment means comprises a rivet cap connectible to a collapsible section of the stem of one of said female sections, whereby the first surface is held between the rivet cap and the base plate.

21. The female portion of the adjustable magnetic snap fastener of claim 16, wherein the stem of at least one of the plurality of female sections has a stem hole substantially in the center thereof.

22. An adjustable magnetic snap fastener for releasably connecting a first surface and a second surface, comprising:

(a) a plurality of male sections, each male section having a stem;

(b) a female section having
- a base washer defining a hole substantially in the center of the base washer;
- a magnetic ring defining a hole substantially in the center of the magnetic ring; and
- attachment means connected to the base washer;
- a non-magnetic cover plate defining a hole substantially in the center of the cover plate having flange means at its periphery, the cover plate being mounted to the base washer by the flange means whereby the holes in the base washer, the magnetic ring and the cover plate are substantially axially aligned;
- a second stem extending through the axially aligned holes;

(c) a base plate for the male sections having a first side and a second side and attachment means connected to the second side of the base plate;

(d) wherein the attachment means connected to the base plate of said male sections is adapted for attachment to the first surface, and the attachment means connected to the base washer of said female section is adapted for attachment to the second surface;

(e) wherein the plurality of male sections is attached to the first surface and all of the male sections are arranged in substantially a straight line, and the female section is attached to the second surface; and (f) whereby insertion of the stem of one of the plurality of male sections into one of the axially aligned holes of the female section creates a magnetic force which releasably connects said one male section and said female section and hence the first and second surfaces attached to the first and second attachment means respectively.

23. The adjustable magnetic snap fastener of claim 22, wherein the base plate defines a plurality of first plate holes whereby the stem of each male section extends through a corresponding one of the plurality of plate holes.

24. The adjustable magnetic snap fastener of claim 22, wherein the stem of at least one of the plurality of male sections has a first stem hole substantially in the center thereof and the stem of the female section has a second stem hole substantially in the center thereof.

25. An adjustable magnetic snap fastener for releasably connecting a first surface and a second surface, comprising:

(a) a female section having
- a base washer defining a first hole substantially in the center of the base washer;
- a magnetic ring defining a second hole substantially in the center of the magnetic ring;
- a non-magnetic cover plate defining a third hole substantially in the center of the cover plate and having a flange means at its periphery, the cover plate being mounted to the base washer by the flange means whereby the magnetic ring is held between the base washer and the cover plate and whereby the first, second, and third holes are substantially axially aligned; and
- a first stem extending through the first, second and third holes;

(b) a plurality of male sections, the male sections having
- a non-magnetic base plate defining holes substantially therethrough; and
- a plurality of stems extending through the holes in the base plate;

(c) first attachment means connected to one side of the base plate and adapted for attachement to the first surface;

(d) second attachment means connected to the base washer of the female section by the first stem and adapted for attachment to the second surface;

(e) wherein at least one of the plurality of male sections is attached to the first surface, and the female section is attached to the second surface; and (f) whereby insertion of one stem of the male section into at least the third hole of the female section creates a magnetic force which releasably connects said male section and said female section and hence the first and second surfaces attached to the first and second attachment means, respectively.

26. The adjustable magnetic snap fastener of claim 25, wherein the base plate defines a plurality of plate holes and whereby the stem of each male section extends through a corresponding one of the plurality of place holes.

* * * * *